US010907382B2

(12) United States Patent
Raffi et al.

(10) Patent No.: US 10,907,382 B2
(45) Date of Patent: Feb. 2, 2021

(54) SECURITY GATE WITH LATCH RELEASE

(71) Applicant: Dorel Juvenile Group, Inc., Foxboro, MA (US)

(72) Inventors: Laura Kay Raffi, Holliston, MA (US); Caroline M. Hunter, Braintree, MA (US); Paul Dowd, Scarsdale, NY (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 112 days.

(21) Appl. No.: 15/825,910

(22) Filed: Nov. 29, 2017

(65) Prior Publication Data

US 2018/0148954 A1 May 31, 2018

Related U.S. Application Data

(60) Provisional application No. 62/427,488, filed on Nov. 29, 2016.

(51) Int. Cl.

| | |
|---|---|
| ***E05B 65/00*** | (2006.01) |
| ***E05B 59/00*** | (2006.01) |
| ***E05C 1/10*** | (2006.01) |
| ***E06B 9/04*** | (2006.01) |
| ***E06B 11/02*** | (2006.01) |
| ***E05C 9/02*** | (2006.01) |
| ***E05C 1/04*** | (2006.01) |
| ***E05B 63/14*** | (2006.01) |
| *E06B 9/00* | (2006.01) |

(52) U.S. Cl.

CPC ..... *E05B 65/0007* (2013.01); *E05B 59/00* (2013.01); *E05B 63/14* (2013.01); *E05C 1/04* (2013.01); *E05C 1/10* (2013.01); *E05C 9/02* (2013.01); *E05C 9/025* (2013.01); *E06B 9/04* (2013.01); *E06B 11/02* (2013.01); *E05B 65/0014* (2013.01); *E06B 2009/002* (2013.01)

(58) Field of Classification Search

CPC . E05B 65/0007; E05B 65/0014; E05B 63/143
See application file for complete search history.

(56) References Cited

U.S. PATENT DOCUMENTS

| | | | |
|---|---|---|---|
| 1,221,954 | A | 4/1917 | Arnold |
| 1,923,804 | A | 8/1933 | Williams et al. |
| 2,057,009 | A | 10/1936 | Chadwick |
| 3,788,689 | A | 1/1974 | Lloyd |
| 4,070,074 | A | 1/1978 | Rohme |
| 4,083,591 | A | 4/1978 | Parisien |
| 4,294,040 | A | 10/1981 | Crotti |
| 4,305,178 | A | 12/1981 | Caplette |
| 4,679,353 | A | 7/1987 | Langenbach et al. |
| 4,831,777 | A | 5/1989 | Johnson, Jr. |
| 4,944,117 | A | 7/1990 | Gebhard et al. |
| 4,993,187 | A | 2/1991 | Schweiss et al. |

(Continued)

FOREIGN PATENT DOCUMENTS

| | | | |
|---|---|---|---|
| GB | 2 088 939 | * | 6/1982 |

*Primary Examiner* — Gregory J Strimbu
(74) *Attorney, Agent, or Firm* — Barnes & Thornburg LLP

(57) ABSTRACT

A gate unit includes a gate mount that can be mount to a doorway, hallway, or staircase. A gate is mounted to the gate mount for pivotable movement between opened and closed positions. The gate unit further includes a two stage gate latch that is configured to latch the gate when the gate is in the closed position.

12 Claims, 9 Drawing Sheets

(56) References Cited

U.S. PATENT DOCUMENTS

| | | | | |
|---|---|---|---|---|
| 5,052,461 | A | 10/1991 | Stern | |
| 5,056,262 | A | 10/1991 | Schweiss et al. | |
| 5,272,840 | A | 12/1993 | Knoedler et al. | |
| 5,367,829 | A | 11/1994 | Crossley et al. | |
| 5,396,732 | A | 3/1995 | Andersen | |
| 5,442,881 | A | 8/1995 | Asbach et al. | |
| 5,528,859 | A | 6/1996 | Taylor et al. | |
| 5,809,694 | A | 9/1998 | Postans | |
| 5,953,860 | A | 9/1999 | Morgan et al. | |
| 6,016,629 | A | 1/2000 | Sylvester et al. | |
| 6,027,104 | A | 2/2000 | Alexander et al. | |
| 6,112,460 | A | 9/2000 | Wagnitz | |
| 6,112,461 | A | 9/2000 | Cheng | |
| 6,176,042 | B1 | 1/2001 | Rossman et al. | |
| 6,178,694 | B1 | 1/2001 | Wagnitz | |
| 6,233,874 | B1 | 5/2001 | Johnson, Jr. | |
| 6,347,483 | B1 | 2/2002 | Andersen | |
| 6,497,254 | B2 | 12/2002 | Thomas et al. | |
| 6,499,254 | B2 * | 12/2002 | Rossman | A01K 1/0017 160/210 |
| 6,536,163 | B1 | 3/2003 | Monahan et al. | |
| 6,536,502 | B2 | 3/2003 | Britto et al. | |
| 6,711,857 | B1 | 3/2004 | Wagnitz et al. | |
| 7,178,792 | B2 | 2/2007 | Monahan et al. | |
| 7,318,298 | B2 | 1/2008 | Marsden et al. | |
| 7,334,624 | B2 | 2/2008 | Waldman et al. | |
| 7,565,769 | B2 | 7/2009 | Monahan et al. | |
| 7,627,985 | B2 | 12/2009 | Marsden et al. | |
| 7,874,103 | B2 | 1/2011 | Yates | |
| 7,950,184 | B2 | 5/2011 | Flannery | |
| 7,963,575 | B2 | 6/2011 | Mayo et al. | |
| 8,418,407 | B2 | 4/2013 | Wang | |
| 8,733,017 | B2 | 5/2014 | Marsden et al. | |
| 9,587,426 | B1 * | 3/2017 | Flannery | E06B 9/04 |
| 9,637,959 | B2 | 5/2017 | Marsden et al. | |
| 10,107,030 | B2 * | 10/2018 | Raffi | E06B 9/04 |
| 10,415,290 | B1 * | 9/2019 | Flannery | E06B 11/022 |
| 2006/0175028 | A1 * | 8/2006 | Askinasi | E05B 65/0014 160/225 |
| 2006/0207180 | A1 * | 9/2006 | Cheng | E05B 65/0014 49/57 |
| 2009/0013604 | A1 | 1/2009 | Yates | |
| 2011/0175046 | A1 | 7/2011 | Flannery et al. | |
| 2011/0225890 | A1 | 9/2011 | Greenwood et al. | |
| 2012/0011775 | A1 * | 1/2012 | Chen | E05B 47/004 49/358 |
| 2015/0089873 | A1 | 4/2015 | Marsden et al. | |
| 2015/0101253 | A1 | 4/2015 | Marsden et al. | |
| 2017/0211314 | A1 | 7/2017 | Raffi et al. | |
| 2018/0112457 | A1 * | 4/2018 | Raffi | E05C 19/06 |

* cited by examiner

SECURITY GATE WITH LATCH RELEASE

PRIORITY CLAIM

This application claims priority under 35 U.S.C. § 119(e) to U.S. Provisional Application No. 62/427,488, filed Nov. 29, 2016, which is expressly incorporated by reference herein.

BACKGROUND

The present disclosure relates to movable barriers, and particularly to security gates. More particularly, the present disclosure relates to gate units including a swinging gate and a latch coupled to the gate to move with the gate as it swings about a gate-pivot axis between opened and closed positions.

SUMMARY

According to the present disclosure, a gate unit includes a gate that can be moved in a doorway or at the top of a staircase by a person between opened and closed positions. In the closed position, the gate is positioned to block movement through the doorway or onto the staircase.

In illustrative embodiments, the gate is arranged to swing about a gate-pivot axis between the opened and closed positions. The gate unit further includes a gate mount that is adapted to mate with a door frame bordering a doorway, a hall frame or wall bordering a hallway, or a staircase frame bordering an entry to a staircase. The gate mount includes hinge-side frame mount adapted to mate with one side of the doorway, hallway, or staircase frame and coupled to a hinge-side end of the swinging gate to establish a gate-pivot axis of the swinging gate. The gate mount also includes a latch-side frame mount adapted to mate with an opposite side of the doorway, hallway, or staircase frame and to a latch carried on a latch-side end of the swinging gate when the gate is moved to assume the closed position.

In illustrative embodiments, the gate unit also includes a gate latch that is coupled to the gate to swing with the gate between opened and closed positions. The gate latch is configured to include spring-loaded first-stage and second-stage latch pins that mate with the latch-side frame mount when the gate arrives at the closed position to block further swinging movement of the gate about the gate-pivot axis.

In illustrative embodiments, the gate unit is configured provide a two-stage latch-pin release system. To release the gate latch from engagement with the latch-side frame mount to free the gate to swing from the closed position to the opened position, the gate operator need only apply a first force to a first trigger included in the gate latch in a first latch-pin release stage while applying a second force to a second trigger included in the latch-side frame mount in a second latch-pin release stage. These forces can be applied manually by the gate operator using, for example, the index finger and the thumb of one hand that has been moved to grip the gate latch so that one-handed release of the gate latch can be accomplished by an informed gate operator having knowledge of the two latch-pin release stages.

In illustrative embodiments, the gate latch includes a top latch coupled to the gate. The top latch includes a first-stage latch pin and a top second-stage latch pin, which first- and second-stage latch pins are aligned with a top pin retainer included in the latch-side frame mount. The gate latch also includes a bottom latch coupled to the gate and arranged to lie below the top latch. The bottom latch includes a bottom second-stage latch pin aligned with a bottom pin retainer included in the latch-side frame mount.

In illustrative embodiments, the gate latch is operated in two latch-pin release stages to withdraw the first-stage latch pin and then the second-stage latch pins from their pin retainers to allow movement of the gate to an opened position. When the gate is closed, the first-stage and the second-stage latch pins are spring-biased to extend into the top pin receiver and the bottom second-stage pin is spring-biased to extend into the bottom pin receiver so that the latch pins are linked temporarily to the latch-side frame mount to retain the gate in the closed position. To open the gate, the first-stage latch pin in the top latch is withdrawn by a gate operator from the top pin receiver and maintained in that withdrawn position in a first stage of latch-pin release and then, in a second stage of latch-pin release, the second-stage latch pins in the top and bottom latches are withdrawn simultaneously by a gate operator from the companion top and bottom pin receivers to free the gate to move relative to the latch-side frame mount from the closed position to the opened position.

In illustrative embodiments, a gate operator completes the latch-side frame mount includes a wall mount bracket coupled to a wall or other frame portion. The latch-side frame mount also includes a spring-loaded movable latch-pin receiver that is mounted for up-and-down movement on the wall-mount bracket. The movable latch-pin receiver includes a top pin retainer associated with the top latch, a bottom pin retainer associated with the bottom latch, a retainer mover arm coupled to the top and bottom pin retainers to move therewith relative to the wall mount bracket, and a retainer-motion trigger coupled to the retainer mover arm for use in the second latch-release stage.

In illustrative embodiments, the gate operator completes a first stage of latch-pin release by withdrawing the first-stage latch pin of the top latch from a companion first pin-receiver slot formed in the top pin retainer of the latch-side frame mount. This is accomplished by moving an index finger in a pulling motion to apply a first force to a pin-motion trigger that is coupled to the first-stage latch pin to move the first-stage latch pin against a biasing force provided by a companion first pin-pusher spring so that the outer tip of the first-stage latch pin is withdrawn from the companion first pin-receiver slot formed in the top pin retainer. In illustrative embodiments, the first-stage latch pin and the pin-motion trigger cooperate to form a monolithic component made of a plastics material.

In illustrative embodiments, a second stage of latch-pin release is completed by the gate operator while the first-stage latch pin is held in the withdrawn position away from its companion first pin-receiver slot formed in the top pin retainer by simultaneously moving the top and bottom pin retainers included in the latch-side frame mount relative to the wall-mount bracket in a downward direction toward the floor underlying the gate unit to cause (1) a top ramp included in the top pin retainer to discharge the top second-stage latch pin from a companion pin-retainer slot formed in the top pin retainer and (2) a top ramp included in the bottom pin retainer to discharge the bottom second-stage latch pin from a companion pin-retainer slot formed in the bottom pin retainer. The gate operator accomplishes this second stage of latch-pin release by moving a thumb on the same hand as the index finger used in the first latch-pin release stage downwardly using a pushing motion to apply a second force to the retainer-motion trigger to push the retainer mover arm downwardly relative to the wall-mount bracket against a biasing force provided by the companion arm-lifting spring so that the top and bottom pin retainers (which are coupled to the retainer mover arm) also move downwardly relative to the wall-mount to cause the top ramps to engage outer tips of the top and bottom second-stage latch pins and to push the second-stage latch pins out of their companion pin-retainer slots so that the gate latch disengages the latch-side frame mount to free the gate to swing about the gate-pivot axis from the closed position to the opened position.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is a perspective view of a gate unit provided with a two-stage latch-pin release system in accordance with the present disclosure suggesting that a gate latch is coupled to a swinging gate for pivotable movement as a unit about a vertical gate-pivot axis established by a gate-pivot support and that the gate latch comprises a top latch coupled to a top rail of the gate and configured to include a stage-one latch pin and a top stage-two latch pin and a bottom latch coupled to the gate to lie below the top latch and configured to include a bottom stage-two latch pin and suggesting that the three latch pins engage a latch-side frame mount included in the gate unit to retain the gate in a closed position;

FIG. 2 is a diagrammatic view of the gate unit of FIG. 1 suggesting that the latch-side frame mount includes a wall-mount bracket mounted in a stationary position on a wall, a top pin retainer aligned with the top latch, and a bottom pin retainer aligned with the bottom latch, and suggesting that a movable stage-one latch-pin release system is coupled to the first-stage latch pin included in the top latch for use by a gate operator to release the first-stage latch pin from the top pin retainer included in the latch-side frame mount as shown, for example, in FIGS. 7 and 8, and suggesting that the top and bottom pin retainers cooperate with a retainer mover arm and a companion arm-lift spring that are also included in the latch-side frame mount to provide a movable stage-two latch-pin release system that is movable relative to the stationary wall-mount bracket and the gate and can be operated by a gate operator in a second latch-pin release stage as shown, for example, in FIGS. 9 and 10 to release simultaneously the top and bottom second-stage latch pins from the companion top and bottom pin retainers included in the latch-side frame mount by moving the retainer mover arm in a downward direction relative to the wall-mount bracket and thereby unlatch the swinging gate so that it can be swung about the gate-pivot axis from the closed position to an opened position;

Figure 1:
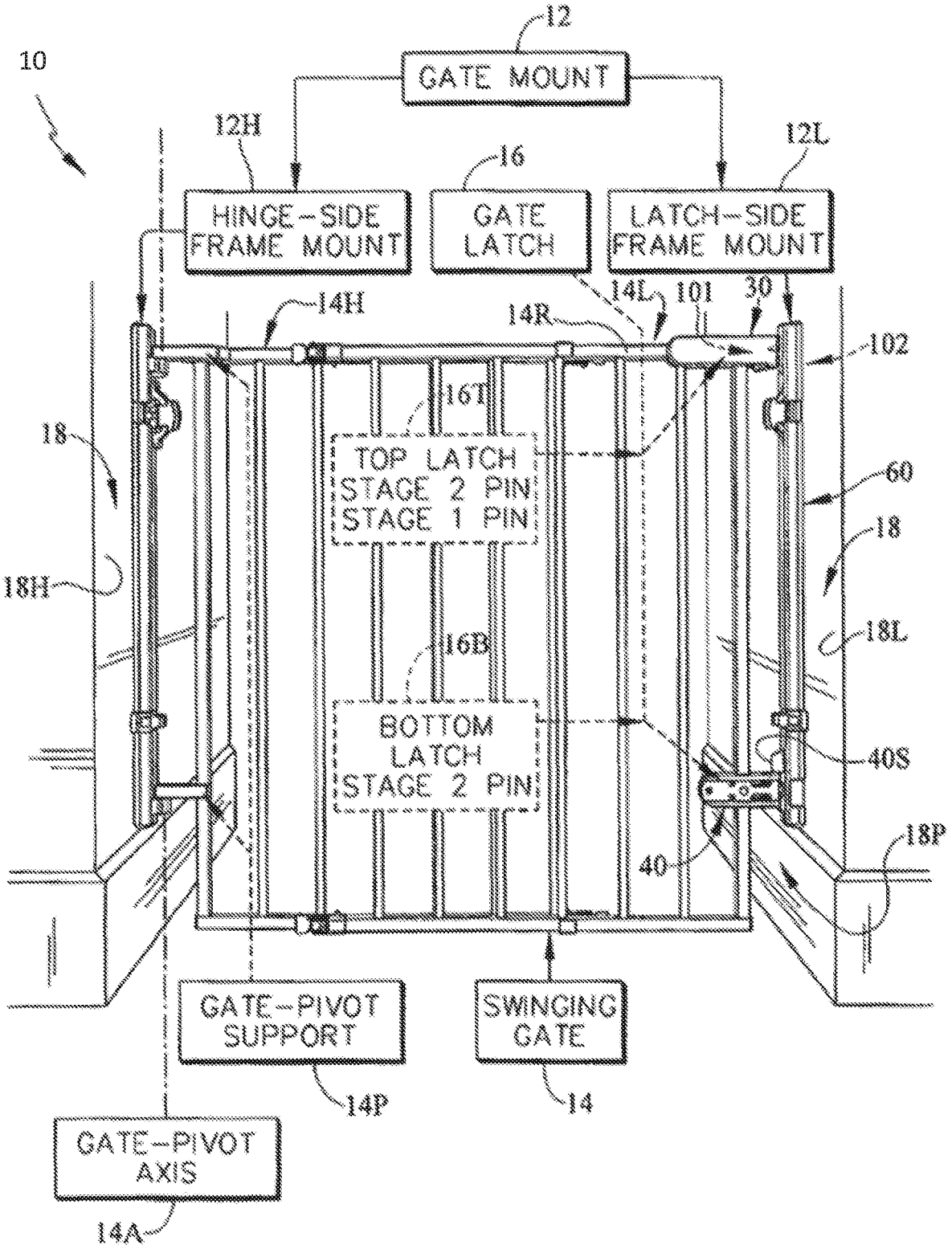
Figure 3:
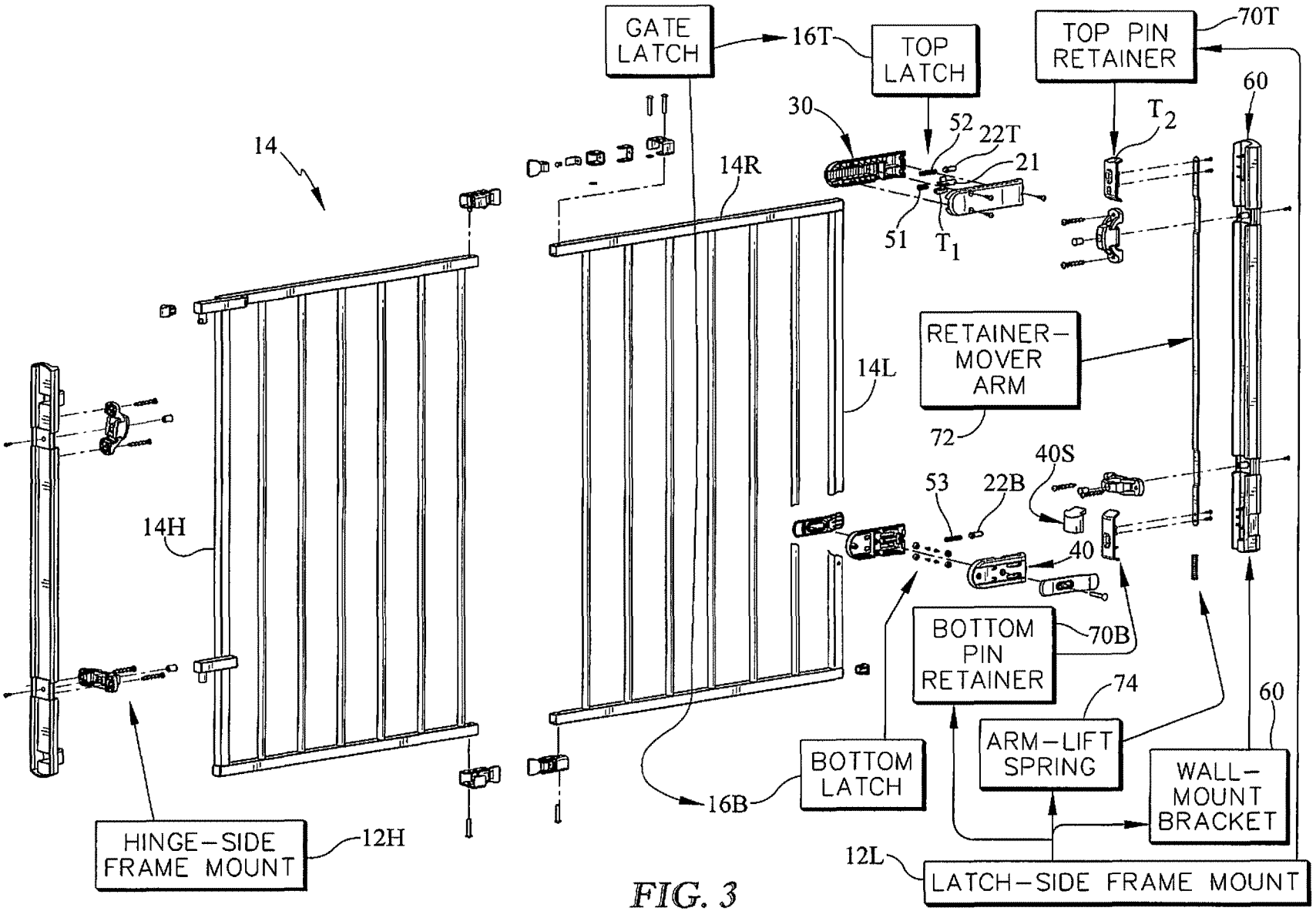
FIG. 3 is an exploded perspective assembly view of the gate unit of FIG. 1 showing that the gate latch comprises top and bottom latches and showing that the latch-side frame mount comprises a wall-mount bracket, a movable retainer mover arm, an arm-lift spring under the retainer mover arm, and top and bottom pin retainers that move up and down with the retainer mover arm.
Figure 6:
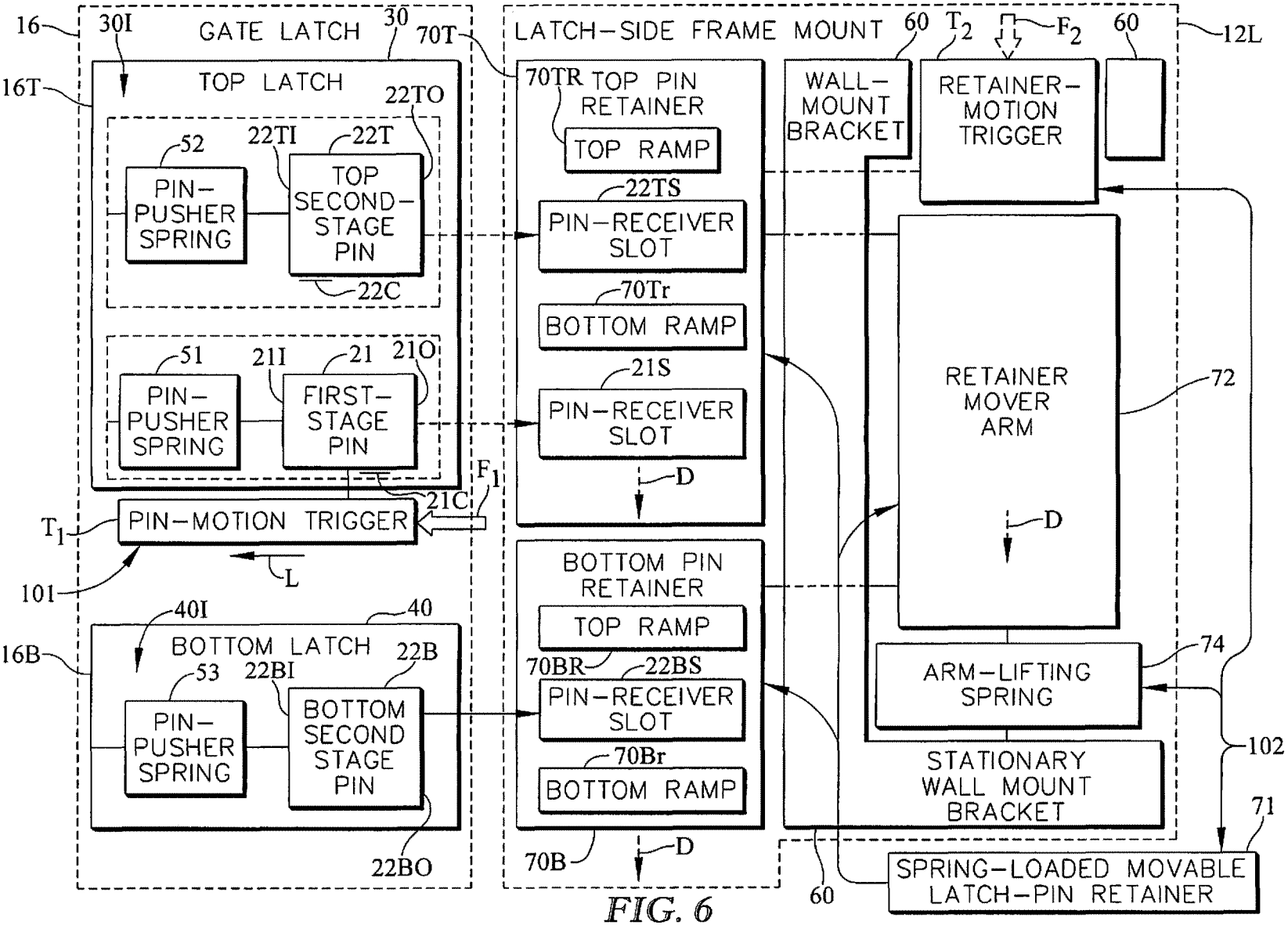
Figure 7:
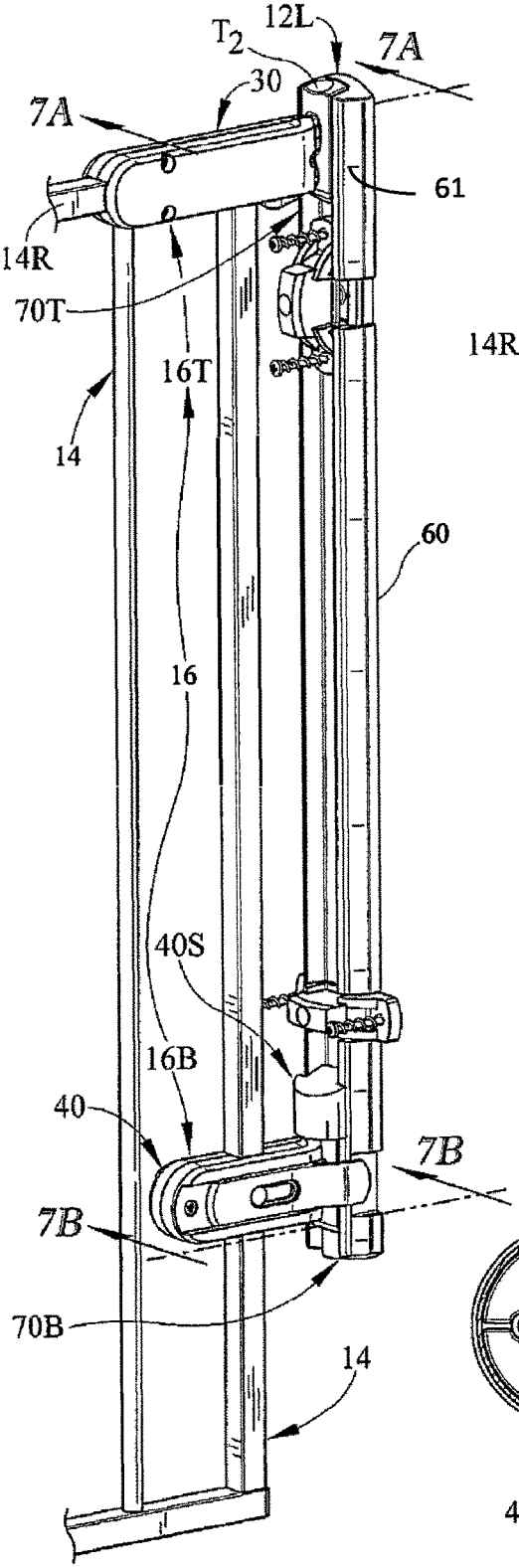
Figure 7A:
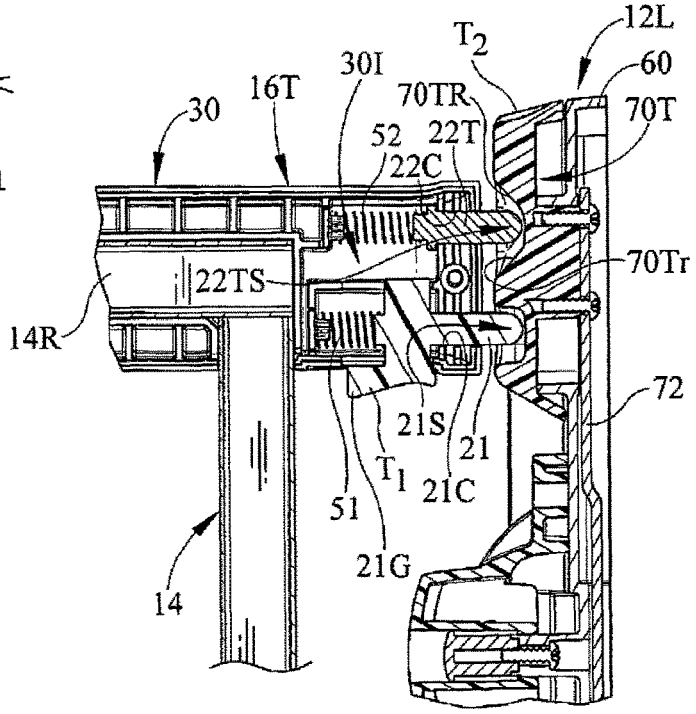
Figure 7B:
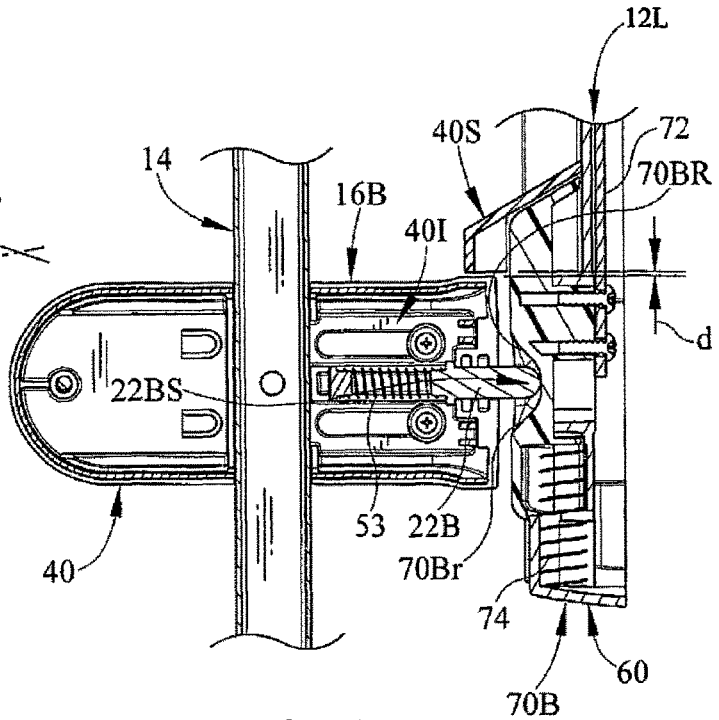
Figure 8:
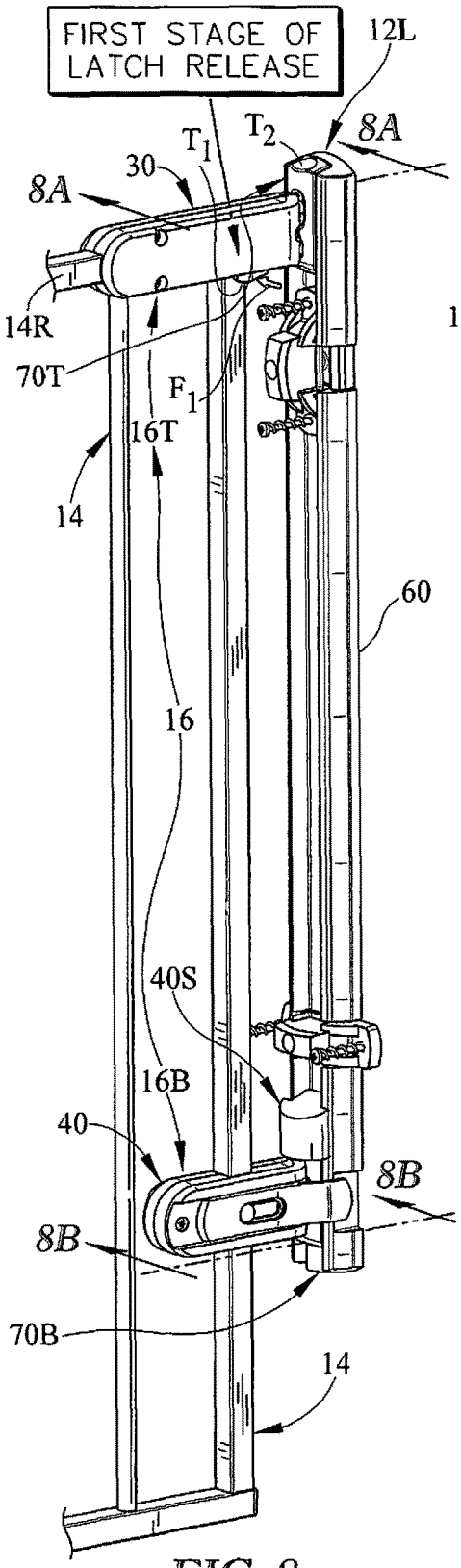
Figure 8A:
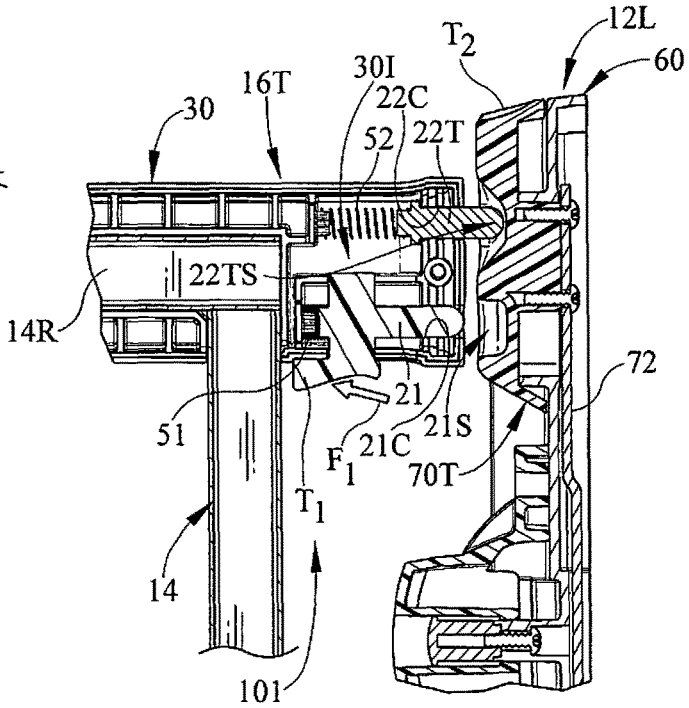
Figure 8B:
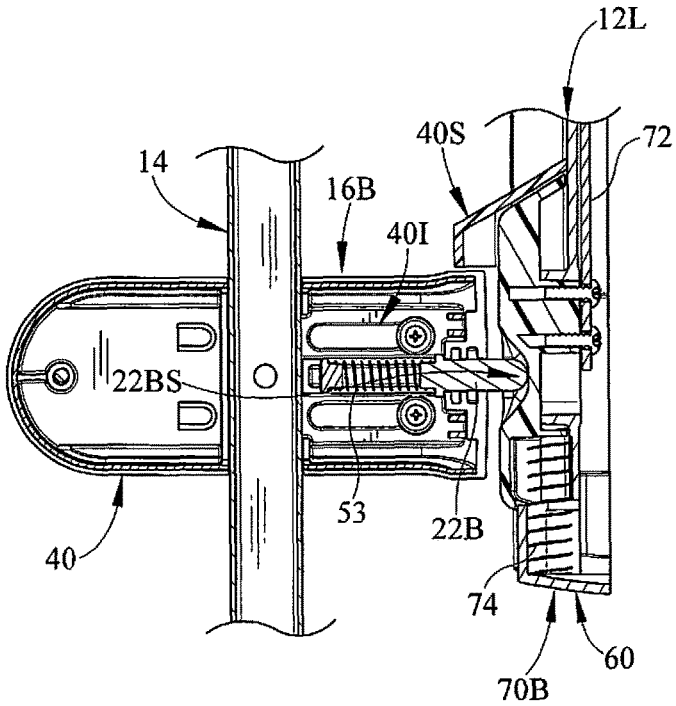
Figure 9:
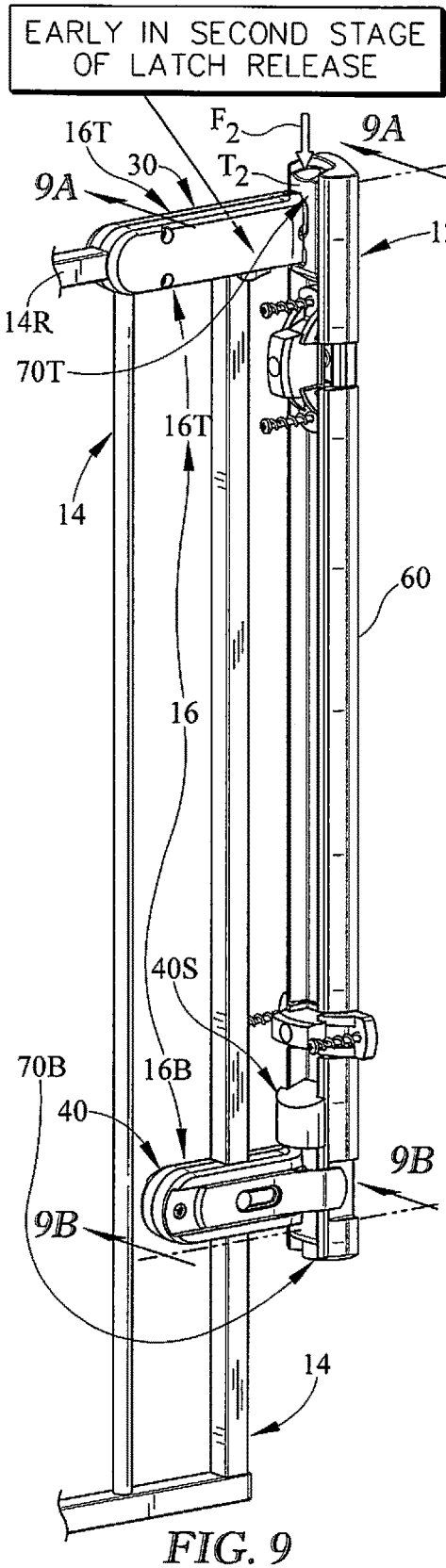
Figure 9A:
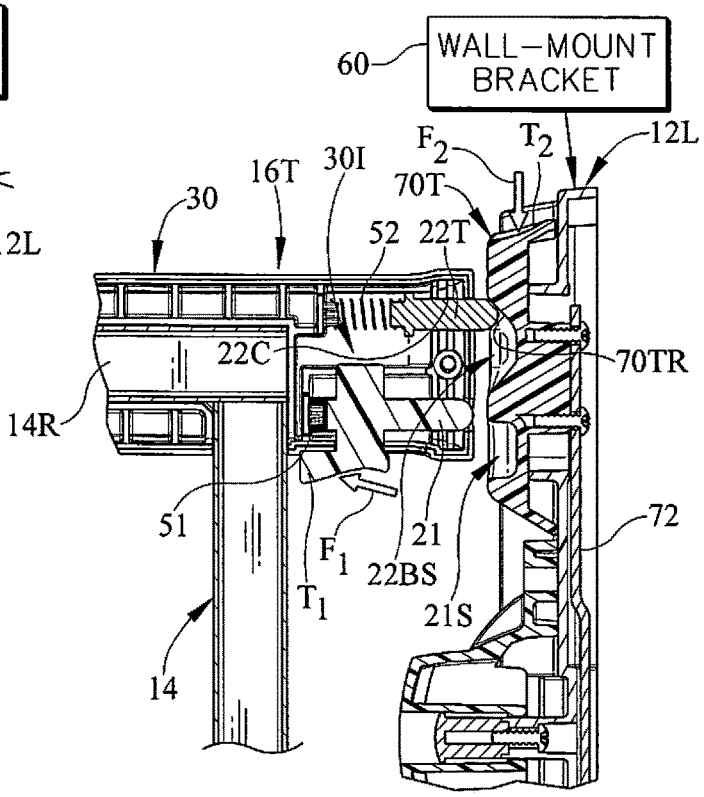
Figure 9B:
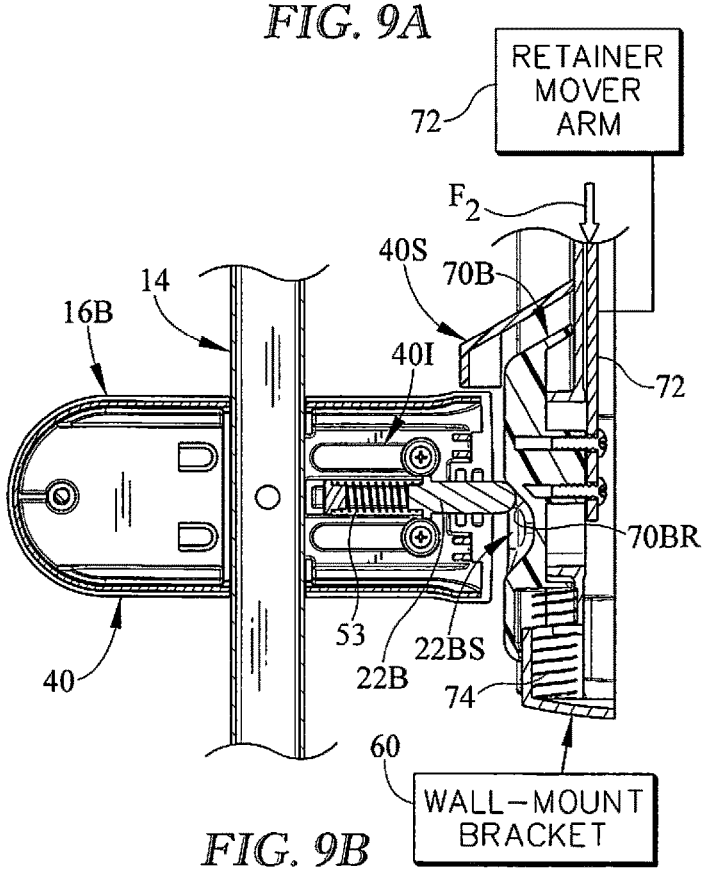
Figure 10:
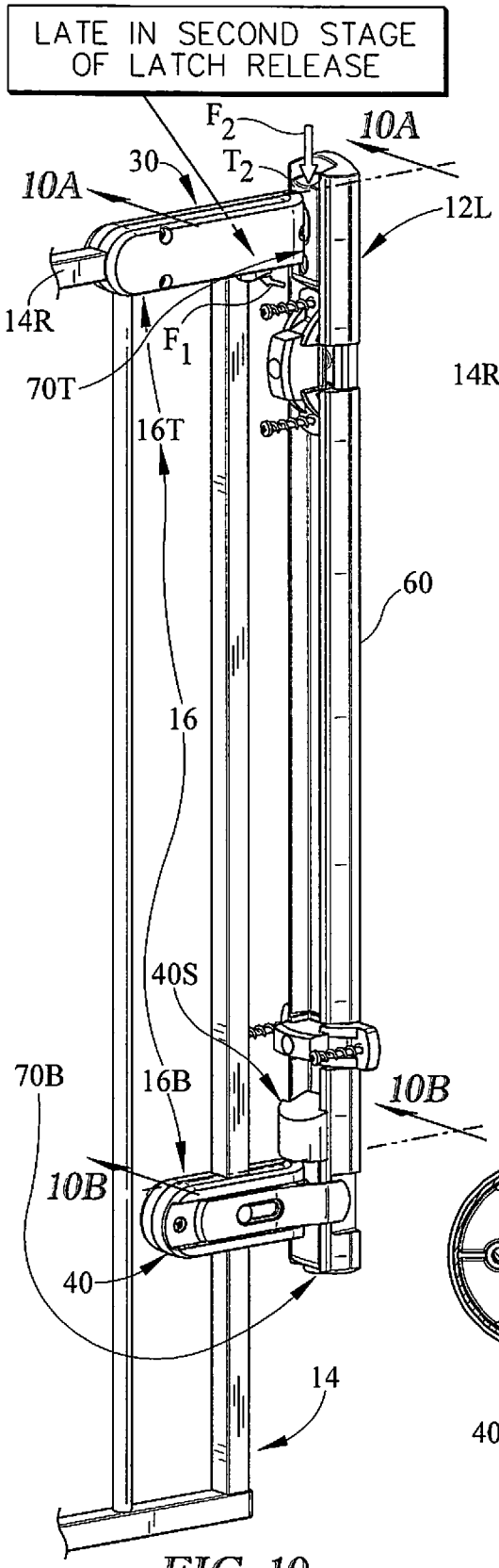
Figure 10A:
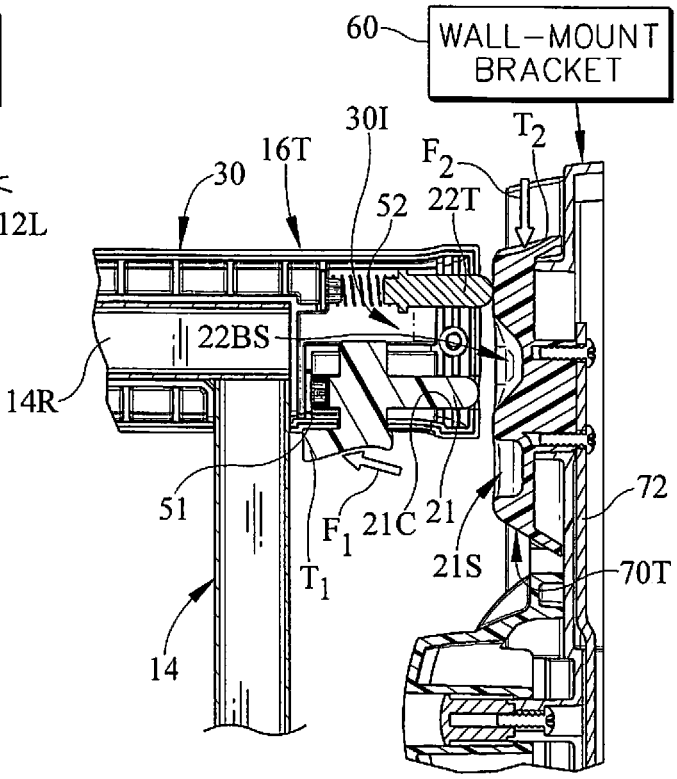
Figure 10B:
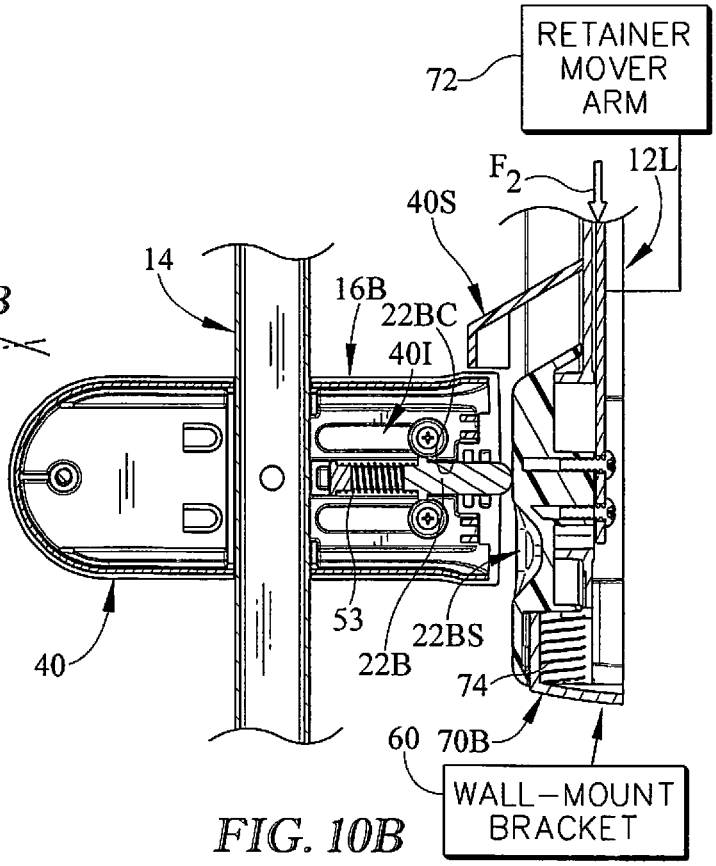

FIG. 6 is a diagrammatic view of components comprising the gate latch and the latch-side frame mount and showing that the gate latch includes a pin-motion trigger for initiating the first stage of latch-pin release and the latch-side frame mount includes a retainer-motion trigger for initiating the second stage of latch-pin release and suggesting that the top pin retainer includes a first-stage pin-receiver slot aligned with the first-stage latch pin and a second-stage pin-receiver slot aligned with the top second-stage latch pin and flanked by top and bottom ramps adapted to engage the outer tip of the top second-stage latch pin during movement of the top pin retainer relative to the wall-mount bracket and the top latch in the second latch-pin release stage (and thereafter) and suggesting that the bottom pin retainer includes a second-stage pin-receiver slot aligned with the bottom second-stage latch pin and flanked by top and bottom ramps adapted to engage the outer tip of the bottom second-stage latch pin during downward movement of the bottom pin retainer relative to the wall-mount bracket and the bottom latch in the second latch-pin release stage (and thereafter);

FIGS. 7-10 show a portion of the illustrative gate unit of FIGS. 1 and 3 to illustrate a two-stage latch-pin release process in accordance with the present disclosure;

FIG. 7 is an enlarged partial perspective view of the gate unit of FIGS. 1 and 3 showing the swinging gate in the closed position;

FIG. 7A is an enlarged sectional view taken along line 7A-7A of FIG. 7 showing insertion of the first-stage latch pin of the top latch into the first-stage pin-receiver slot formed in the top pin retainer and showing insertion of the top second-stage latch pin of the top latch into the second-stage pin-receiver slot formed in the top pin retainer included in the latch-side frame mount;

FIG. 7B is an enlarged section view taken along line 7B-7B of FIG. 7 showing insertion of the bottom second-stage latch pin of the bottom latch into the second-stage pin-receiver slot formed in the bottom pin retainer included in the latch-side frame mount;

FIG. 8 is a view similar to FIG. 7 during a first stage of latch-pin release in accordance with the present disclosure;

FIG. 8A is an enlarged sectional view taken along line 8A-8A of FIG. 8 showing withdrawal of the first-stage latch pin of the top latch from the first-stage pin-receiver slot formed in the top pin retainer in response to application of a first force $F_1$ by a caregiver to a pin-motion trigger included in the top latch while the outer tip of the top second-stage latch pin remains in place in the second-stage pin-receiver slot formed in the top pin retainer;

FIG. 8B is an enlarged sectional view taken along line 8B-8B showing insertion of the bottom second-stage latch pin of the bottom latch into the second-stage pin-receiver slot formed in the bottom pin retainer;

FIG. 9 is a view similar to FIGS. 7 and 8 during an early part of the second stage of latch-pin release in accordance with the present disclosure;

FIG. 9A is an enlarged sectional view taken along line 9A-9A of FIG. 9 showing continued withdrawal of the first-stage latch pin of the top latch from the first-stage pin-receiver slot formed in the top pin retainer and application of a second force $F_2$ by the caregiver in a downward direction to a top surface of the retainer-motion trigger of the latch-side frame mount (while the caregiver continues to apply the first force $F_1$ to the pin-motion trigger of the top latch) to cause downward movement of the top pin retainer relative to the wall-mount bracket and to the top latch to cause the top ramp of the top pin retainer to engage the outer tip of the top second-stage latch pin and urge the top second-stage latch pin to move to the left to compress the companion second pin-pusher spring so that withdrawal of the top second-stage latch pin from the second-stage pin-receiver slot of the top pin retainer is initiated;

FIG. 9B is an enlarged section view taken along line 9B-9B of FIG. 9 showing that the downward second force $F_2$ applied to the top surface of the retainer-motion trigger is transferred by the top pin retainer to the retainer mover arm to cause the retainer move arm to move downwardly relative to the wall-mount bracket so as to cause the bottom pin retainer that is coupled to a lower portion of the retainer mover arm also to move downwardly relative to the wall-mount bracket and to the bottom latch to cause the top ramp of the bottom pin retainer to engage the outer tip of the bottom second-stage latch pin and urge the bottom second-stage latch pin to move to the left to compress the companion second pin-pusher spring so that withdrawal of the bottom second-stage latch pin from the second-stage pin-receiver slot of the bottom pin retainer is initiated and showing initial compression of the arm-lifting spring underlying the retainer mover arm;

FIG. 10 is a view similar to FIGS. 7-9 during a later part of the second stage of latch-pin release in accordance with the present disclosure;

FIG. 10A is an enlarged sectional view taken along line 10A-10A of FIG. 10 showing that both of the first-stage and the second-stage latch pins of the top latch have been withdrawn from their companion pin-receiver slots formed in the top latch; and FIG. 10B is an enlarged sectional view taken along line 10B-10B of FIG. 10 showing that the bottom second-stage latch pin of the bottom latch has been withdrawn from the companion second-stage pin-receiver slot of the bottom pin retainer to free the gate to swing about the gate-pivot axis from the closed position to an opened position.

DETAILED DESCRIPTION

Figure 2:
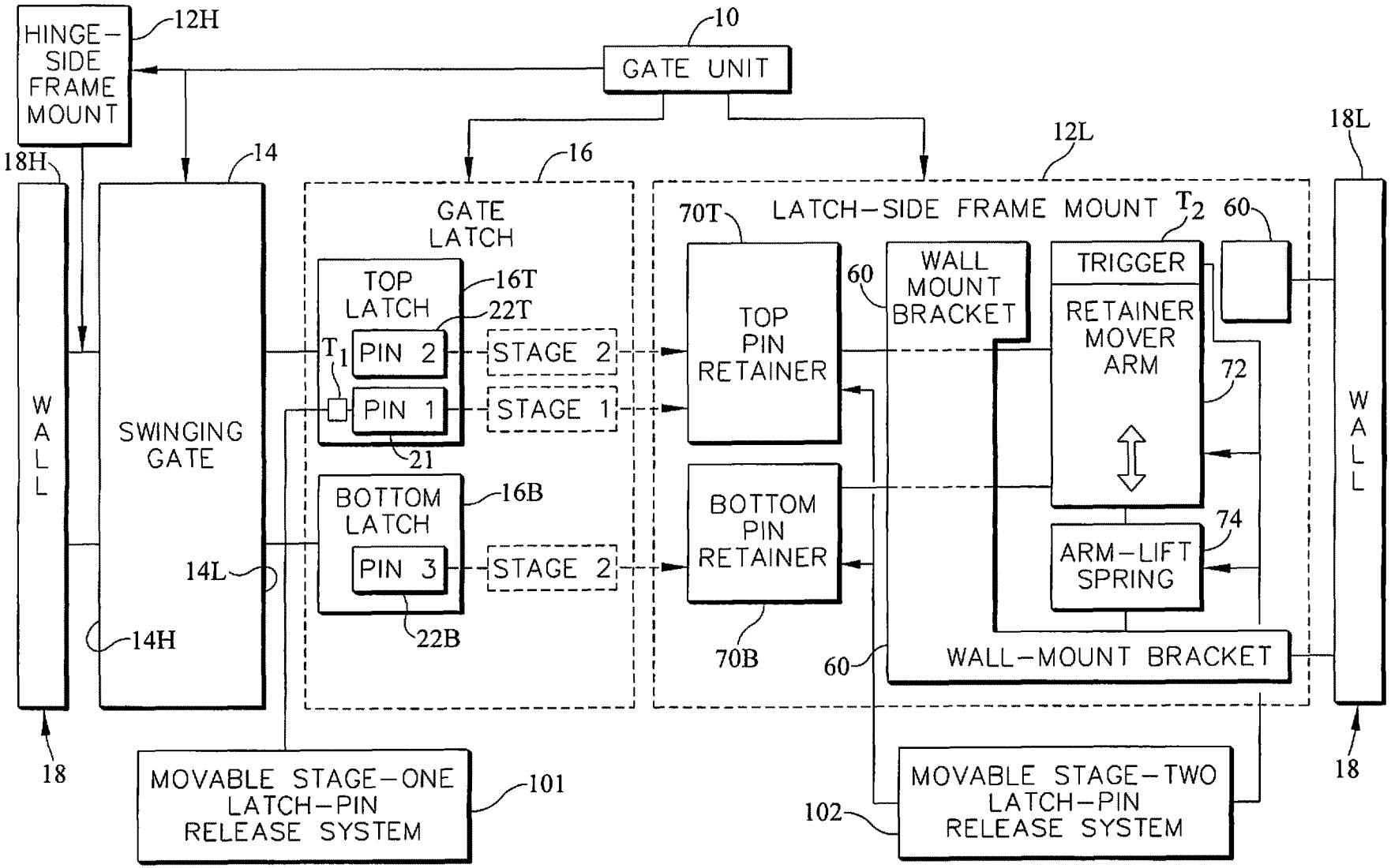

A gate unit 10 is provided with a two-stage latch-pin release system 101, 102 is accordance with the present disclosure as suggested in FIGS. 1 and 2. Gate unit 10 includes a gate mount 12, a swinging gate 14 arranged to move relative to gate mount 12 between opened and closed positions, and a gate latch 16 coupled to gate 14 to move therewith. When gate 14 is moved to the closed position, each of a first-stage latch pin 21, a top second-stage latch pin 22T, and a bottom second-stage latch pin 22B included in gate latch 16 mates with a latch-side frame mount 12L included in gate mount 12 to retain gate 14 in the closed position as suggested diagrammatically in FIG. 2 and illustratively as suggested in FIGS. 7, 7A, and 7B. As suggested in FIG. 2, a movable stage-one latch pin release system 101 is used to withdraw first-stage latch pin 21 from engagement with latch-side frame mount 12L to initiate unlatching of gate latch 16 from latch-side frame mount 12L as suggested diagrammatically in FIG. 2 and illustratively in FIGS. 8, 8A, and 8B. A movable stage-two latch-pin release system 102 is used to withdraw top and bottom second-stage latch pins 22T, 22B simultaneously from engagement with latch-side frame mount 12L to complete unlatching of gate latch 16 from latch-side frame mount 12L so that gate 14 is free to be moved from the closed position to the opened position as suggested diagrammatically in FIG. 2 and illustratively in FIGS. 9-9B and 10-10B.

An informed gate operator, having knowledge as to how to (1) release the first-stage latch pin 21 using a first trigger $T_1$ included in gate latch 16 and (2) release the second-stage top and bottom latch pins 22T, 22B using a second trigger $T_2$ included in latch-side frame mount 12L can unlock the gate 14 so that gate 14 can be opened. In accordance with the present disclosure, the gate operator manually applies a first force $F_1$ (as suggested in FIG. 6) to a first (pin-motion) trigger $T_1$ included in gate latch 16 to disengage the first-stage latch pin 21 from latch-side frame mount 12 as suggested in FIGS. 7, 7A, 8, and 8A. Then, while continuing to apply the first force $F_1$ to first pin-motion trigger $T_1$ as suggested in FIGS. 9A and 10A, the gate operator manually applies a second force $F_2$ (as suggested in FIG. 6) to a second (retainer-motion) trigger $T_2$ included in latch-side frame mount 12L to disengage simultaneously the top and bottom second-stage latch pins 22T, 22B from latch-side frame mount 12L as suggested in FIGS. 9-9B and 10-10B so that gate 14 can be moved from the closed position to an opened position.

Gate mount 12 is adapted to mate with opposing portions 18H, 18L of a doorway, hallway, staircase, or other frame or wall 18 as suggested illustratively in FIG. 1 and diagrammatically in FIG. 2. Although each of the portions 18H, 18L shown in FIG. 1 is a portion of a wall, it is also within the scope of the present disclosure to attach gate mount 12 to doorjambs, staircase posts, or other suitable frame portions to support gate 14 for swinging (or sliding or other) movement between opened and closed positions. In illustrative embodiments, gate 14 is supported on a gate-pivot support 14P for swinging movement about a vertical gate-pivot axis 14A as suggested in FIG. 1.

As suggested in FIGS. 1 and 2, gate mount 12 includes a first (hinge-side) frame mount 12H that is adapted to be held in an stationary position on a first frame or wall portion 18H and a second (latch-side) frame mount 12L that is adapted to be held in a stationary position on an opposing second frame or wall portion 18L. A hinge-side end 14H of gate 14 is pivotably coupled to a gate-pivot support 14P of hinge-side frame mount 12H at gate-pivot axis 14A. Gate latch 16 is coupled to an opposite latch-side end 14L of gate 14 and is arranged to engage latch-side frame mount 12L when gate 14 is swung about the vertical gate-pivot axis 14A to assume the closed position.

Figure 5:
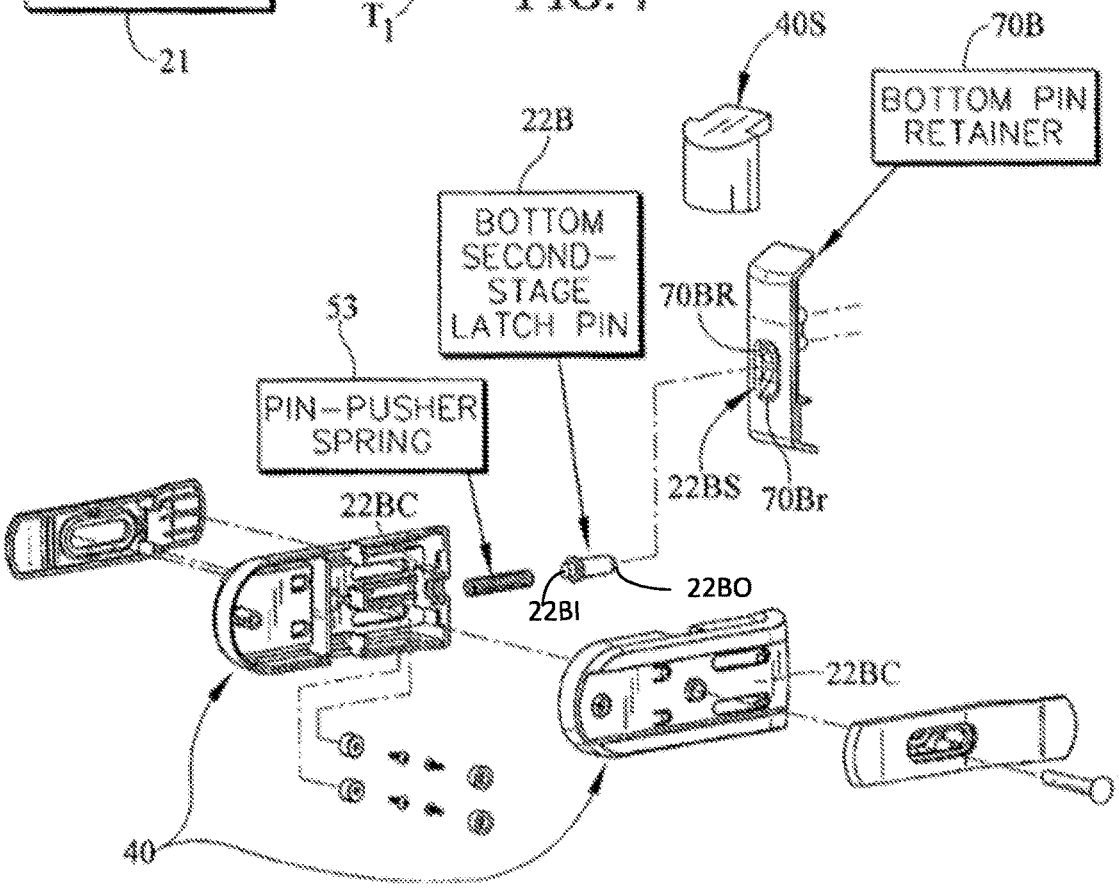
FIG. 5 is an enlarged exploded perspective view of the illustrative bottom latch of FIGS. 1 and 3 alongside an enlarged perspective view of the illustrative bottom pin receiver of FIGS. 1 and 3.

Gate latch 16 includes a top latch 16T including first-stage latch pin 21 and top second-stage latch pin 22T as suggested in FIGS. 2, 5, and 6. First-stage latch pin 21 is arranged to lie below top second-stage latch pin 22T as suggested diagrammatically in FIGS. 2 and 6 and illustratively in FIG. 8A. Gate latch 16 also includes a pin-motion trigger $T_1$ that is coupled to first-stage latch pin 21 as suggested diagrammatically in FIGS. 2 and 6 and illustratively in FIG. 8A. In illustrative embodiments, first-stage latch pin 21 and pin-motion trigger $T_1$ are made of a plastics material and cooperate to form a monolithic component as shown in FIG. 8A. Top second-stage latch pin 22T is made of a metal material in an illustrative embodiment.

Top latch 16T includes a housing 30 that is coupled to a top rail 14R of gate 14 and formed to include an interior region 301 receiving top second-stage latch pin 22T and the underlying first-stage latch pin 21 as suggested diagrammatically in FIG. 6 and illustratively in FIG. 7A. A first pin-pusher spring 51 is located in the interior region 301 and arranged to act against housing 30 to apply a yieldable biasing force to an inner end 211 of first-stage latch pin 21 to urge an outer tip 21O of first-stage latch pin 21 to engage latch-side frame mount 12L when gate 14 is moved to assume the closed position. A second pin-pusher spring 52 is located in the interior region 301 and arranged to act against housing 30 to apply a yieldable biasing force to an inner end 22TI of top second-stage latch pin 22T to urge an outer tip 22TO of top second-stage latch pin 22T to engage latch-side frame mount 12L when gate 14 is moved to assume the closed position.

Gate latch 16 also includes a bottom latch 16B including bottom second-stage latch pin 22B as suggested diagrammatically in FIG. 6 and illustratively in FIG. 7. Bottom latch 16B also includes a housing 40 formed to include an interior region 401 receiving bottom second-stage latch pin 22B therein as suggested diagrammatically in FIG. 6 and illustratively in FIG. 7A. A third pin-pusher spring 53 is located in the interior region 401 and arranged to act against housing 40 to apply a yieldable biasing force to an inner end 22BI of bottom second-stage latch pin 22B to urge an outer tip 22BO of bottom second-stage latch pin 22B to engage latch-side frame mount 12L when gate 14 is moved to assume the closed position.

Latch-side frame mount 12L includes a wall-mount bracket 60 coupled to a frame or wall portion 18L as suggested illustratively in FIGS. 1 and 7 and diagrammatically in FIG. 2. The latch-side frame mount 12L also includes a spring-loaded movable latch-pin retainer 71 that is mounted for up-and-down movement on wall-mount bracket 60 as suggested in FIGS. 7-10. The movable latch-pin retainer 71 includes a top pin retainer 70T associated with the top latch 16T and configured to receive the outer tips 21O, 22TO of latch pins 21, 22T, a bottom pin retainer 70B associated with the bottom latch 16B and configured to receive the outer tip of 22BO of bottom second-stage latch pin 22B, a retainer mover arm 72 coupled to top and bottom pin retainers 70T, 70B to move therewith relative to wall-mount bracket 60, and a retainer-motion trigger $T_2$ coupled to top pin retainer 70T for use in the second latch-pin release stage. It is within the scope of the present disclosure to couple retainer-motion trigger $T_2$ to retainer mover arm 72 for use in the second latch-pin release stage.

Gate unit 10 is configured to provide a two-stage latch-pin release system and also includes a gate latch 16 that is coupled to gate 14 to swing with gate 14 between opened and closed positions. Gate latch 16 is configured to include spring-loaded first-stage and second-stage latch pins 21, 22T, 22B that mate with latch-side frame mount 12L when gate 14 arrives at the closed position to block further swinging movement of gate 14 about gate-pivot axis 14A.

To release gate latch 16 from engagement with latch-side frame mount 12L to free gate 14 to swing from the closed position to the opened position, the gate operator need only apply a first force $F_1$ to a first trigger $T_1$ included in gate latch 16 in first stage while applying a second force $F_2$ to a second trigger $T_2$ included in latch-side frame mount 12L. These forces $F_1$, $F_2$ can be applied manually by the gate operator using, for example, the index finger and the thumb of one hand that has been moved to grip the gate latch 16 so that one-handed release of the gate latch 16 can be accomplished by an informed gate operator having knowledge of the two latch-pin release stages.

Gate latch 16 includes a top latch 16T coupled to gate 14 as suggested in FIGS. 2, 6, and 7-10. Top latch 16T includes a first-stage latch pin 21 and a top second-stage latch pin 22T. First- and second-stage latch pins 21, 22T are aligned with top pin retainer 70T included in the movable latch-pin retainer 71 of the latch-side frame mount 12L as suggested in FIG. 6. Gate latch 16 also includes a bottom latch 16B coupled to gate 14 and arranged to lie below top latch 16T as suggested in FIGS. 1, 2, and 7-10. Bottom latch 16B includes a bottom second-stage latch pin 22B aligned with bottom pin retainer 70B included in the movable latch-pin retainer 71 of the latch-side frame mount 12L as suggested in FIG. 6.

Gate latch 16 is operated to withdraw the first-stage latch pin 21 and then the second-stage latch pins 22T, 22B from their companion pin retainers 70T, 70B to allow movement of gate 14 to an opened in two latch-pin release stages as suggested in FIGS. 8-8A, 9-9B, and 10-10B. When gate 14 is closed as suggested in FIGS. 7-7B, the first-stage latch pin 21 and the second-stage latch pin 22T are spring-biased to extend into top pin retainer 70T and the bottom second-stage pin 22B is spring-biased to extend into bottom pin retainer 70B so that the three latch pins 21, 22T, 22B are linked temporarily to the latch-side frame mount 12L to retain gate 14 in the closed position. To open gate 14, the first-stage latch pin 21 in top latch 16T is withdrawn by a gate operator from top pin retainer 70T and maintained in that withdrawn position in a first stage of latch-pin release as suggested in FIGS. 8 and 8A. Then, in a second stage of latch-pin release, the second-stage latch pins 22T, 22B in the top and bottom latches 16T, 16B are withdrawn simultaneously by a gate operator from the companion top and bottom pin retainers 70T, 70B to free gate 14 to move relative to the latch-side frame mount 12L from the closed position to an opened position as suggested in FIGS. 9-9B and 10-10B.

In illustrative embodiments, a first stage of latch-pin release is completed by withdrawing first-stage latch pin 21 of top latch 16T from a companion pin-receiver slot 21S formed in top pin retainer 70T of latch-side frame mount 12L. This is accomplished by moving an index finger in a pulling motion to apply a first force $F_1$ to a pin-motion trigger $T_1$ that is coupled to the first-stage latch pin 21 to move first-stage latch pin 21 against a biasing force provided by a companion first pin-pusher spring 51 so that the outer tip 21O of the first-stage latch pin 21 is withdrawn from the companion first pin-receiver slot 21S formed in top pin retainer 70T. In illustrative embodiments, the first-stage latch pin 21 and the pin-motion trigger $T_1$ cooperate to form a monolithic component made of a plastics material.

In illustrative embodiments, a second stage of latch-pin release is completed while the first-stage latch pin 21 is held in the withdrawn position away from its companion pin-receiver slot 21S by simultaneously moving the top and bottom pin retainers 70T, 70B included in the latch-side frame mount 12L downwardly toward the floor underlying gate unit 10 to cause (1) a downwardly moving top ramp 70TR included in top pin retainer 70T to engage and discharge the top second-stage latch pin 22T from a companion pin-receiver slot 22TS formed in the top pin retainer 70T and (2) a downwardly moving top ramp 70BR included in bottom pin retainer 70B to engage and discharge the bottom second-stage latch pin 22B from a companion pin-receiver slot 22BS formed in bottom pin retainer 70B. This is accomplished by moving a thumb on the same hand as the index finger used in the first stage downwardly using a pushing motion to apply a second force to the retainer-motion trigger T2 to move top pin retainer 70T downwardly to push the retainer mover arm 72 downwardly against a biasing force provided by the companion arm-lifting spring 74 so that the bottom pin retainer 70B which is coupled to the retainer mover arm 72 also moves downwardly to cause the top ramps 70TR, 70BR to engage the outer tips 22T0, 22BO of top and bottom second-stage latch pins 22T, 22B and to push the second-stage latch pins 22T, 22B out of their companion pin-receiver slots 22TS, 22BS so that gate latch 16 disengages latch-side frame mount 12L to free gate 14 to swing from the closed position to the opened position.

Top pin retainer 70T includes a first-stage pin-retainer slot 21S aligned with first-stage latch pin 21 and a second-stage pin-retainer slot 22TS aligned with top second-stage latch pin 22T and flanked by top and bottom ramps 70TR, 70Tr adapted to engage the outer tip 22TO of the top second-stage latch pin 22T during downward movement of the top pin retainer 70T relative to the top latch 16T in the second latch-release stage (and thereafter) as suggested in FIGS. 6 and 7A. Bottom pin retainer 70B includes a second-stage pin-retainer slot 22BS aligned with the bottom second-stage latch pin 22B and flanked by top and bottom ramps 70BR, 70Br adapted to engage the outer tip 22BO of the bottom second-stage latch pin during downward movement of the bottom pin retainer 70B relative to the bottom latch 16B in the second latch-release stage (and thereafter) as suggested in FIGS. 6 and 7B.

Swinging gate 14 is shown in the closed position in FIG. 7. First-stage latch pin 21 of top latch 16T is inserted into the first-stage pin-receiver slot 21S formed in top pin retainer 70T and top second-stage latch pin 22T of top latch 16T is inserted into the second-stage pin-receiver slot 22TS formed in top pin retainer 16T included in the movable latch-pin retainer 71 of latch-side frame mount 12L as shown in FIG. 7A. Bottom second-stage latch pin 22B of bottom latch 16B is inserted into the second-stage pin-receiver slot 22BS formed in bottom pin retainer 70B included in the movable latch-pin retainer 71 of latch-side frame mount 12L as shown in FIG. 7B.

A first stage of latch-pin release in accordance with the present disclosure is shown in FIGS. 8-8B. Withdrawal of first-stage latch pin 21 of top latch 16T from the first-stage pin-receiver slot 21S formed in top pin retainer 70T is accomplished in response to application of a first force $F_1$ by a caregiver in a horizontal direction to a pin-motion trigger $T_1$ included in top latch 16T while the outer tip 22TO of top second-stage latch pin 22T remains in place in the second-stage pin-receiver slot 22TS formed in the top pin retainer 70T as shown in FIG. 8A. Bottom second-stage latch pin 22B of bottom latch 16B is inserted into the second-stage pin-receiver slot 22BS formed in bottom pin retainer 70B as shown in FIG. 8B.

An early part of the second stage of latch-pin release in accordance with the present disclosure is shown in FIGS. 9-9B. Continued withdrawal of first-stage latch pin 21 of top latch 16T from the first-stage pin-retainer slot 21S formed in top pin retainer 70T and application of a second force $F_2$ by the caregiver in a downward direction to a top surface of retainer-motion trigger $T_2$ of latch-side frame mount 12L (while the caregiver continues to apply the first force $F_1$ to the pin-motion trigger $T_1$ of top latch 16T) causes downward movement of top pin retainer 70T relative to wall-mount bracket 60 and to top latch 16T to cause the top ramp 70TR of top pin retainer 70T to engage the outer tip 22TO of top second-stage latch pin 22T and urge the top second-stage latch pin 22T to move to the left to compress the companion pin-pusher spring 52 so that withdrawal of the top second-stage latch pin 22T from the second-stage pin-receiver slot 22S of the top pin retainer 70T is initiated. A downward second force $F_2$ applied to the top surface of the retainer-motion trigger $T_2$ is transferred by top pin retainer 70T to retainer mover arm 72 to cause retainer move arm 72 to move downwardly relative to the stationary wall-mount bracket 60 so as to cause bottom pin retainer 70B that is coupled to a lower portion of retainer mover arm 72 also to move downwardly relative to wall-mount bracket 60 and to bottom latch 16B to cause the top ramp 70BR of bottom pin retainer 70B to engage the outer tip 22BO of bottom second-stage latch pin 22B and urge bottom second-stage latch pin 22B to move to the left to compress the companion pin-pusher spring 53 so that withdrawal of bottom second-stage latch pin 22B from the second-stage pin-receiver slot 22BS of bottom pin retainer 70B is initiated and initial compression of the arm-lifting spring 74 underlying the retainer mover arm 72 takes place.

A later part of the second stage of latch pin-release in accordance with the present disclosure is shown in FIGS. 10-10B. Both of the first-stage and the second-stage latch pins 21, 22T of top latch 16T have been withdrawn from their companion pin-receiver slots 21S, 22TS formed in top latch 16T as shown in FIG. 10A. Bottom second-stage latch pin 22B of bottom latch 16B has been withdrawn from the companion second-stage pin-receiver slot 22BS of bottom pin retainer 70B to free gate 14 to swing about gate-pivot axis 14A from the closed position to an opened position.

A swing stop 40S is included in latch-side frame mount 12L as suggested in FIG. 1 to provide means for blocking unauthorized upward movement of bottom pin retainer 70B in an effort to lift gate 14 upwardly to cause the spring-biased bottom second-stage latch pin 22B of gate latch 16 to disengage the companion bottom second pin-retainer slot 22BS formed in bottom pin retainer 70B of latch-side frame mount 12L without applying a second force $F_2$ to the top surface of second retainer-motion trigger $T_2$ while applying a first force $F_1$ to first pin-motion trigger $T_1$. If such unauthorized upward movement of gate 14 is attempted, bottom latch 40 of gate latch 16 will move upwardly a very small distance (d) and then engage the stationary swing stop 40S so that further upward movement of gate 14 is blocked as suggested in FIG. 7B. The interference between moving bottom latch 40 and stationary swing stop 40S blocks gate 14 from being lifted upwardly to release the second-stage latch pins 22T, 22B.

Gate 14 is opened in accordance with the present disclosure without any lifting of gate 14 relative to companion hinge-side and latch-side frame mounts 12H, 12L. This helps with usability and to maintain the structural integrity of gate unit 10. By providing a spring-biased top second-stage latch pin 22T in top latch 16T in accordance with the present disclosure, security and balance is enhanced by keeping gate 14 fully latched at the top and bottom even after first trigger $T_1$ is pulled to cause the spring-biased first-stage latch pin 21 to be disengaged in the first stage of latch-pin release as suggested in FIGS. 8-8B. First trigger $T_1$ is arranged in accordance with the present disclosure to release first-stage latch pin 21 in a first stage of latch-pin release when exposed to a pull-back action force $F_1$ applied to the underside of top latch 16T in a location that is less accessible to an unknowing child that may attempt to operate latch 16.

As suggested in FIG. 6, a movable stage-two latch-pin release system 102 comprises a spring-loaded movable latch-pin receiver 71 and an arm-lifting spring 74. Latch-pin receiver 71 comprises top pin retainer 70T, bottom pin retainer 70B, retainer-motion trigger $T_2$, and a retainer mover arm 72 coupled to top and bottom pin retainers 70T, 70B to move therewith relative to wall-mount bracket 60. In use, the second stage of latch-pin release is accomplished by moving latch-pin retainer 71 downwardly to compress arm-lifting spring 74 and cause the spring-loaded top and bottom second-stage latch pins 22T, 22B to be rammed out of engagement with companion pin-receiver slots 22TS, 22BS formed in top and bottom pin retainers 70T, 70B. This allows for both second-stage latch pins 22T, 22B to be activated and released at the same time in response to application of a downward force $F_2$ to the retainer-motion trigger $T_2$ as suggested in FIGS. 9-9B and 10-10B.

Gate 14 of gate unit 10 can be slammed shut by a user because all of the first- and second-stage latch pins 21, 22T, and 22B move freely using compression springs 51, 52, 53 and do not lock out at any point. This mechanism is able to achieve dual action without any latch pins 51-53 locking out because each latch pin is only responsible for one of the actions. First stage latch pin 21 locks the vertical motion of gate 14 when in the locked position and second-stage latch pins 22T, 22B lock side-to-side swinging motion of gate 14.

Figure 4:
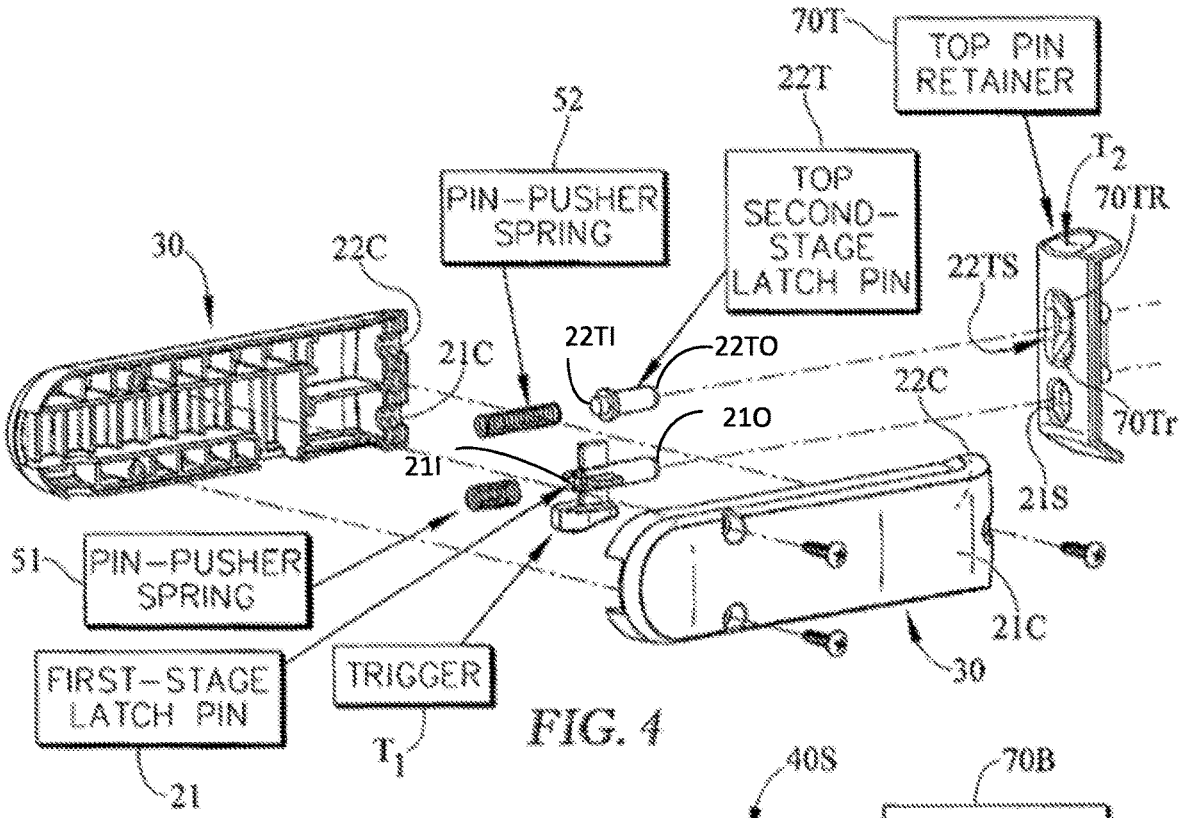
FIG. 4 is an enlarged exploded perspective view of the illustrative top latch of FIGS. 1 and 3 alongside an enlarged perspective view of the illustrative top pin receiver of FIGS. 1 and 3.

A multi-stage latch release process is disclosed herein for operating a gate latch 16 coupled to a swinging gate 14 mounted for pivotable movement on a gate mount 12 mated with a frame 18 bordering a passageway 18P as suggested in FIG. 1 to release gate latch 16 from engagement with a latch-side frame mount 12L included in gate mount 12 so as to free the swinging gate 14 to swing from a closed position to an opened position. The process includes the steps of (1) withdrawing a first-stage latch pin 21 included in gate latch 16 as suggested in FIG. 8A from a first pin-receiver slot 21S formed in a top pin retainer 70T included in latch-side frame mount 12L to free top pin retainer 70T to be moved downwardly from a raised position to a relatively lower lowered position relative to the swinging gate 14 while the swinging gate 14 is in the closed position and relative to a wall-mount bracket 60 also included in latch-side frame mount 12L and mounted in a stationary position on the frame 18 bordering the passageway 18P and (2) moving the top pin retainer 70T downwardly relative to the swinging gate 14 and the bracket 60 as suggested in FIGS. 9A and 10A from the raised position to the relatively lower lowered position while the first-stage latch pin 21 is withdrawn from the first pin-receiver slot 21S formed in top pin retainer 70T and the swinging gate 14 is in the closed position to discharge a top second-stage latch pin 22T included in gate latch 12 from a second pin-receiver slot 22TS also formed in top pin retainer 70T so as to disengage gate latch 16 from latch-side frame mount 12L to free the swinging gate 14 to pivot about the gate-pivot axis 14A from the closed position to the opened position. Bracket 60 has an outer surface 61 that is ramped to cooperate with rounded tips 210, 22T0, and 22B0 of latch pins, 21, 22T and, 22B, as shown in FIGS. 4, 5, and 7, to allow latch pins, 21, 22T and, 22B to withdraw as gate 14 returns to the closed position.

The withdrawing step includes the step of applying a first force $F_1$ to a pin-motion trigger $T_1$ that is coupled to the first-stage latch pin 21 as suggested in FIGS. 6 and 8A to move the first-stage latch pin 21 against a biasing force provided by a first pin-pusher spring 51 included in gate latch 16 so that an outer tip 21O of the first-stage latch pin 21 is withdrawn from the first pin-retainer slot 21S formed in top pin retainer 70T. The moving step includes the step of applying a second force $F_2$ to a retainer-motion trigger $T_2$ that is coupled to top pin retainer 70T as suggested in FIGS. 9A and 10A while the first force $F_1$ is being applied to the pin-motion trigger $T_1$ to cause top pin retainer 70T and retainer mover arm 72 to move downwardly relative to the bracket 60 to compress an arm-lifting spring 74 acting between the retainer mover arm 72 and the bracket 60 so that the top pin retainer 70T is moved relative to the bracket 60 from the raised position to the relatively lower lowered position to cause an inclined top ramp 70TR included in top pin retainer 70T to apply a lateral force to an outer tip 22TO of the top second-stage latch pin 22T to move the top second-stage latch pin 22T against a top second pin-pusher spring 52 included in gate latch 16 so that the outer tip 22TO of the top second-stage latch pin 22T is withdrawn from the second pin-retainer slot 22TS formed in top pin retainer 70T.

The first force $F_1$ is applied laterally to the pin-motion trigger $T_1$ by a finger of a gate operator gripping the gate latch 16 with a first hand in illustrative embodiments. The second force $F_2$ is applied downwardly to the retainer-motion trigger $T_2$ by a thumb included in the first hand of the gate operator in illustrative embodiments.

The multi-stage latch release process further comprises the step of lowering a bottom pin retainer 70B included in latch-side frame mount 12L and located below top pin retainer 70T relative to the swinging gate 14 and the bracket 60 from a raised position to a relatively lower lowered position at the same time that the top pin receiver 70T is being moved in the moving step so as to discharge a bottom second-stage latch pin 22B included in gate latch 16 from a second pin-receiver slot 22BS formed in bottom pin retainer 70B so as to disengage gate latch 16 from latch-side frame mount 12L to free the swinging gate 14 to pivot about the gate-pivot axis 14A from the closed position to the opened position. This lowering step is suggested, for example, in FIGS. 9B and 10B.

A gate unit 10 in accordance with the present disclosure includes a swinging gate 14 arranged for pivotable movement about a gate-pivot axis 14A and formed to include a hinge-side end 14H and a latch-side end 14L as suggested in FIG. 2. Gate unit 10 also includes a gate mount 12 adapted to mate with a frame 18 bordering a passageway 18P as suggested in FIG. 1.

Gate mount 12 includes a hinge-side frame mount 12H adapted to mate with one side of the frame 18 bordering the passageway 18P and coupled to the swinging gate 14 to establish the gate-pivot axis 14A and support the swinging gate 14 for pivotable movement about the gate-pivot axis 14A between opened and closed positions as suggested in FIG. 1. Gate mount 12 further includes a latch-side frame mount 12L adapted to mate with an opposite side of the frame 14 bordering the passageway 18P and lie in a spaced-apart location to the hinge-pivot axis 14A to locate the latch-side end 14L of the swinging gate 14 therebetween as also suggested in FIG. 1. The latch-side frame mount 12L includes a bracket 60 adapted to mate with the opposite side of the frame 18 bordering the passageway 18P as suggested in FIG. 1 and a spring-loaded movable latch-pin retainer 71 formed to include separate first and second pin-receiver slots 21S, 22S as suggested in FIG. 6 and arranged to move up and down relative to the latch-side end 14L of the swinging gate 14 between a raised position and a relatively lower lowered position as suggested in FIGS. 7-10.

Gate unit 10 further includes a gate latch 16 that is coupled to the latch-side end 14L of the swinging gate 14 to move with the swinging gate 14 about the gate-pivot axis 14A. Gate latch 16 is arranged to engage the latch-side frame mount 12L in a releasable manner when the swinging gate 14 occupies the closed position to retain the swinging gate 14 temporarily in the closed position as suggested in FIGS. 7-10.

Gate latch 16 includes a first-stage latch pin 21 arranged to extend into the first pin-receiver slot 21S formed in the spring-loaded movable latch-pin retainer 71 of latch-side frame mount 12L when the swinging gate 14 occupies the closed position to block pivotable movement of the swinging gate 14 and block up-and-down movement of the spring-loaded movable latch-pin retainer 71 relative to the latch-side end 14L of the swinging gate 14 as suggested in FIG. 7. Gate latch 16 also includes a top second-stage latch pin 22T arranged to extend into the second pin-receiver slot 22TS formed in the spring-loaded movable latch-pin retainer 71 of the latch-side frame mount 12L when the swinging gate 14 occupies the closed position to block pivotable movement of the swinging gate 14 and as long as the spring-loaded movable latch-pin retainer 71 remains in the raised position as suggested in FIG. 7A. The spring-loaded movable latch-pin retainer 71 is aligned with the bracket 60 to be moved downwardly from the raised position toward the relatively lower lowered position while the first-stage latch-pin 21 is withdrawn from the first pin-receiver slot 21S formed in the spring-loaded movable latch-pin retainer 71 to discharge the top second-stage latch pin 22T from the second pin-receiver slot 22TS formed in the spring-loaded movable latch-pin retainer 71 of latch-side frame mount 12L so as to disengage gate latch 16 from latch-side frame mount 12L of gate mount 12 to free the swinging gate 14 to pivot about the gate-pivot axis 14A from the closed position to the opened position as suggested in FIGS. 7-10.

Gate latch 16 further includes a pin-motion trigger $T_1$ coupled to first-stage latch pin 21 to establish a movable stage-one latch-pin release system 101 as suggested in FIG. 2. The latch-side frame mount 12L further includes a retainer-motion trigger $T_2$ coupled to the spring-loaded movable latch-pin retainer 71 to establish a movable stage-two latch-pin release system 102 shown in FIG. 2 that cooperates with the movable stage-one latch-pin release system 101 to provide two-stage latch-pin release means for releasing gate latch 16 from engagement with latch-side frame mount 12L in sequential first and second stages as suggested in FIGS. 7-10 to free the swinging gate 14 to pivot about the gate-pivot axis 14A from the closed position to the opened position in response to application of a first force $F_1$ by a gate operator to pin-motion trigger $T_1$ in a first latch-pin release stage to withdraw first-stage latch pin 21 from the first pin-receiver slot 21S formed in the spring-loaded movable latch-pin retainer 71 to a withdrawn position as shown in FIG. 8A to disengage the spring-loaded movable latch-pin retainer 71 of latch-side frame mount 12L and free the spring-loaded movable latch-pin retainer 71 to be moved downwardly relative to bracket 60 and to latch-side end 12L of the swinging gate 14 from the raised position to the relatively lower lowered position and then to application of a second force $F_2$ by the gate operator to retainer-motion trigger $T_2$ as shown in FIGS. 9A and 10A while continuing to apply the first force $F_1$ to the movable pin-motion trigger $T_1$ to maintain first-stage latch pin 21 in the withdrawn position to cause the spring-loaded movable latch-pin retainer 71 to move relative to bracket 60 and to the swinging gate 14 from the raised position to the relatively lower lowered position to disengage top second-stage latch pin 22T from the second pin-receiver slot 22TS formed in the movable latch-pin retainer 21 so that none of the first-stage and top second-stage latch pins 21, 22T are engaged to latch-side frame mount 21L so as to free the swinging gate 14 to pivot about the gate-pivot axis 14A from the closed position to the opened position.

Gate latch 16 further includes a housing 30 coupled to the swinging gate to pivot with the swinging gate 14 about the gate-pivot axis 14A and formed to include a first-stage pin channel 21C supporting first-stage latch pin 21T for back-and-forth movement relative to housing 30 as suggested in FIGS. 7A and 8A. Gate latch 16 further includes a first pin-pusher spring 51 arranged to act against housing 30 to apply a yieldable biasing force to an inner end 211 of first-stage latch pin 21 to urge an outer tip 21O of first-stage latch pin 21 to extend into the first pin-receiver slot 21S formed in the spring-loaded movable latch-pin retainer 71 of latch-side frame mount 12L as shown, for example, in FIG. 7A. Pin-motion trigger $T_1$ includes an inner end coupled to first-stage latch pin 21 and an outer end arranged to extend through an opening formed in the housing 30 and suggested in FIG. 7A to provide an operator-finger grip 21G exposed and arranged to receive application of the first force $F_1$ to cause the first-stage latch pin 21 to be moved away from the spring-loaded movable latch-pin retainer 71 to compress the first pin-pusher spring 51 and exit the first pin-receiver slot 21S formed in the spring-loaded movable latch-pin retainer 71 to free the spring-loaded movable latch-pin retainer 71 to be moved downwardly relative to bracket 60 from the raised position to the relatively lower lowered position.

Housing 30 of gate latch 16 is also formed to include a second-stage pin channel 22C supporting top second-stage latch pin 22T for back-and-forth movement relative to housing 30 as suggested in FIGS. 7A, 8A, 9A, and 10A. Gate latch 16 also includes a second pin-pusher spring 52 arranged to act against housing 30 to apply a yieldable biasing force to an inner end 22TI of top second-stage latch pin 22T to urge an outer tip 22TO of second-stage latch pin 22T into the second latch-pin slot 22TS formed in the spring-loaded movable latch-pin retainer 71 of latch-side frame mount 12L as shown, for example, in FIGS. 7A and 8A. The spring-loaded movable latch-pin retainer 71 further includes a top ramp 70TR associated with the second latch-pin receiver slot 22TS and configured to provide means for engaging the outer tip 22TO of top second-stage latch pin 22T as suggested in FIG. 9A during downward movement of the spring-loaded movable latch-pin 71 retainer relative to bracket 60 to move top second-stage latch pin 22T in the second-stage pin channel 22C to compress the second pin-pusher spring 52 and to discharge top second-stage latch pin 22T from the second latch-pin receiver slot 22S formed in the spring-loaded movable latch-pin retainer 71 to free the swinging gate 14 to pivot about the gate-pivot axis 14A from the closed position to the opened position.

The spring-loaded movable latch-pin retainer 71 further includes a bottom ramp 70Tr arranged to lie in spaced-apart relation to top ramp 70TR to locate the second latch-pin receiver slot 22TS therebetween as suggested in FIG. 7A. Top ramp 70TR is inclined to have a negative slope. Bottom ramp 70Tr is inclined to have a positive slope.

The spring-loaded movable latch-pin retainer 71 includes a top pin retainer 70T formed to include first and second pin-receiver slots 21S, 22S and a retainer mover arm 72 mounted on bracket 60 for up-and-down movement relative to bracket 60 as shown diagrammatically in FIG. 6 and illustratively in FIGS. 7-10. Retainer mover arm 72 is coupled to top pin retainer 70T to move relative to bracket 60 in response to movement of retainer mover arm 72 relative to bracket 60 as suggested in FIGS. 9A and 10A. Latch-side frame mount 12L further includes an arm-lift spring 74 coupled to retainer mover arm 72 and to bracket 60 and configured to provide spring means for yieldably urging the spring-loaded movable latch-pin retainer to the raised position.

Latch-side frame mount further includes a retainer-motion trigger $T_2$ coupled to top pin retainer 70T and arranged to be exposed to a gate operator using pin-motion trigger $T_1$ in the first latch-pin release stage as suggested in FIGS. 6 and 7. Retainer-motion trigger $T_2$ is configured to provide means for receiving the second force $F_2$ applied by the gate operator to move top pin retainer 70T and retainer mover arm 72 downwardly relative to bracket 16 as suggested in FIGS. 9A and 10A to compress arm-lift spring 74 during downward movement of the spring-loaded movable latch-pin retainer 71 from the raised position to the relatively lower lowered position.

Gate latch 16 includes a top latch 16T comprising first-stage latch pin 21 and top second-stage latch pin 22 and a bottom latch 16B coupled to latch-side end 12L of gate 14 and arranged to lie below and in spaced-apart relation to the top latch 16T as suggested in FIGS. 6 and 7. Bottom latch 16B includes a bottom second-stage latch pin 22B arranged to move in a channel 22BC formed in housing 40 to extend into a bottom second-pin-receiver slot 22BS formed in the spring-loaded movable latch-pin retainer 71 of latch-side frame mount 12L when the swinging gate 14 occupies the closed position as suggested in FIG. 7B.

The spring-loaded movable latch-pin retainer 71 includes a top pin retainer 70T that is formed to include the first and second pin-receiver slots 21S, 22TS and an upper pin-discharge ramp 70BR adjacent to the second pin-receiver slot 22TS as suggested in FIGS. 6 and 7A. The spring-loaded movable latch-pin retainer 71 also includes a bottom pin retainer 70B that is formed to include the bottom second pin-receiver slot 22BS and a lower pin-discharge ramp 70Br adjacent to the bottom second pin-receiver slot 22BS as suggested in FIGS. 6 and 7B. The upper pin-discharge ramp 70TR is configured to provide top cam means for discharging an outer tip 22BO of top second-stage latch pin 22T included in top latch 70T from the second pin-receiver slot 22TS formed in top pin retainer 70 during downward movement of the spring-loaded movable latch-pin retainer 71 from the raised position to the relatively lower lowered position as suggested in FIGS. 9A and 10A. The lower pin-discharge ramp 70BR is configured to provide bottom cam means for disengaging an outer tip 22BO of bottom second-stage latch pin 22B included in bottom latch 70B from the bottom second pin-receiver slot 22BS formed in bottom pin 70B retainer during downward movement of the spring-loaded movable latch-pin retainer 71 from the raised position to the relatively lower lowered position as suggested in FIGS. 9B and 10B.

Latch-side frame mount 12L further includes a swing stop 40S located in a stationary position between the upper and lower pin-discharge ramps 70BR, 70Br as suggested in FIGS. 7 and 7B. Swing stop 40S is configured to provide means for blocking unauthorized upward movement of bottom pin retainer 70B relative to bracket 60 in an effort to lift the swinging gate 14 upwardly to cause bottom second-stage latch pin 22B to disengage the bottom second pin-retainer slot 22BS formed in bottom pin 22S formed in top pin retainer 70T retainer 70B without first withdrawing first-stage latch pin 21 from the first pin-receiver slot 21S formed in top pin retainer 70T and second-stage latch pin 22T from the second pin-receiver slot 22S formed in top pin retainer 70T so that the swinging gate 14 cannot be lifted upwardly relative to bracket 60 to discharge top second-stage latch pin 22T in top latch 16T from the second pin-receiver slot 22TS formed in top pin retainer 70T and to discharge bottom second-stage latch pin 22B in bottom latch 16B from the bottom pin-receiver slot 16BS formed in bottom pin retainer 70B.

The invention claimed is:

1. A process for operating a gate latch coupled to a swinging gate mounted for pivotable movement on a gate mount mated with a frame or wall to release the gate latch from engagement with a latch-side frame mount of the gate mount so as to free the swinging gate to swing from a closed position to an opened position, the process including the steps of withdrawing a first-stage latch pin of the gate latch from a first pin-receiver slot formed in a top pin retainer of the latch-side frame mount to free the top pin retainer to be moved downwardly from a raised position to a relatively lower lowered position relative to the swinging gate while the swinging gate is in the closed position and relative to a bracket of the latch-side frame mount, the bracket mounted in a stationary position on the frame or wall and moving the top pin retainer relative to the swinging gate and the bracket downwardly from the raised position to the relatively lower lowered position while the first-stage latch pin is withdrawn from the first pin-receiver slot formed in the top pin retainer and while the swinging gate is in the closed position to discharge a top second-stage latch pin of the gate latch from a second pin-receiver slot also formed in the top pin retainer so as to disengage the gate latch from the latch-side frame mount to free the swinging gate to pivot about a gate-pivot axis from the closed position to the opened position.

2. The process of claim 1, wherein the withdrawing step includes applying a first force to a pin-motion trigger that is coupled to the first-stage latch pin to move the first-stage latch pin against a biasing force provided by a first pin-pusher spring of the gate latch so that an outer tip of the first-stage latch pin is withdrawn from the first pin-receiver slot formed in the top pin retainer.

3. The process of claim 2, wherein the moving step includes applying a second force to a retainer-motion trigger that is coupled to the top pin retainer while the first force is being applied to the pin-motion trigger to cause the top pin retainer and a retainer mover arm coupled to the top pin retainer to move downwardly relative to the bracket to compress an arm-lift spring acting between the retainer mover arm and the bracket so that the top pin retainer is moved relative to the bracket from the raised position to the relatively lower lowered position to cause an inclined top ramp of the top pin retainer to apply a lateral force to an outer tip of the top second-stage latch pin to move the top second-stage latch pin against a top second pin-pusher spring of the gate latch so that the outer tip of the top second-stage latch pin is withdrawn from the second pin-receiver slot formed in the top pin retainer.

4. The process of claim 3, wherein the first force is applied laterally to the pin-motion trigger by a finger of a gate operator gripping the gate latch with a hand and the second force is applied downwardly to the retainer-motion trigger by a thumb of the hand of the gate operator.

5. The process of claim 3, further comprising lowering a bottom pin retainer, included in the latch-side frame mount and located below the top pin retainer, relative to the swinging gate and the bracket from a raised position to a relatively lower lowered position at the same time that the top pin retainer is being moved in the moving step to discharge a bottom second-stage latch pin of the gate latch from a bottom second pin-receiver slot formed in the bottom pin retainer so as to disengage the gate latch from the latch-side frame mount to free the swinging gate to pivot about the gate-pivot axis from the closed position to the opened position.

6. The process of claim 3, wherein the gate latch further includes a housing coupled to the swinging gate to pivot with the swinging gate about the gate-pivot axis and the housing includes a first-stage pin channel supporting the first-stage latch pin for movement of the first-stage latch pin relative to the housing, the first pin-pusher spring is arranged to act against the housing to apply the biasing force to an inner end of the first-stage latch pin, and the pin-motion trigger includes an inner end coupled to the first-stage latch pin and an outer end arranged to extend through an opening formed in the housing to provide an exposed operator-finger grip which is arranged to receive the first force to cause the first-stage latch pin to be withdrawn from the first pin-receiver slot and compress the first pin-pusher spring.

7. The process of claim 6, wherein the housing also includes a second-stage pin channel supporting the top second-stage latch pin for movement of the top second-stage latch pin relative to the housing and the top second pin-pusher spring is arranged to act against the housing to apply a yieldable biasing force to an inner end of the top second-stage latch pin to urge the outer tip of the top second-stage latch pin into the second pin-receiver slot formed in the top pin retainer when the swinging gate is in the closed position, and the second pin-receiver slot includes a top ramp configured to engage the outer tip of the top second-stage latch pin when the swinging gate is in the closed position and the top pin retainer is moved downwardly from the raised position to the relatively lower lowered position to move the top second-stage latch pin in the second-stage pin channel to compress the top second pin-pusher spring and to discharge the top second-stage latch pin from the second pin-receiver slot formed in the top pin retainer.

8. The process of claim 7, wherein the second pin-receiver slot further includes a bottom ramp arranged to lie in spaced-apart relation to the top ramp to locate the second pin-receiver slot therebetween.

9. The process of claim 3, wherein the retainer mover arm is coupled to the top pin retainer for movement relative to the bracket in response to movement of the top pin retainer relative to the bracket, and wherein the arm-lift spring is configured to yieldably urge the top pin retainer to the raised position.

10. The process of claim 1, wherein the swinging gate includes a hinge-side end and a latch-side end, the gate mount includes a hinge-side frame mount mated with the frame or wall and coupled to the swinging gate to define the gate-pivot axis and support the swinging gate for pivotable movement about the gate-pivot axis, the top pin retainer of the latch-side frame mount is biased toward the raised position by a spring and is arranged to move up and down relative to the latch-side end of the swinging gate between the raised position and the relatively lower lowered position, and the gate latch is coupled to the latch-side end of the swinging gate to move with the swinging gate about the gate-pivot axis, when the swinging gate is in the closed position and the first-stage latch pin extends into the first pin-receiver slot, the first-stage latch pin blocks pivotable movement of the swinging gate and blocks up-and-down movement of the top pin retainer relative to the latch-side end of the swinging gate, and the top second-stage latch pin extends into the second pin-receiver slot to block pivotable movement of the swinging gate when the swinging gate is in the closed position and the top pin retainer is in the raised position.

11. The process of claim 10, wherein the gate latch includes a top latch comprising the first-stage latch pin and the top second-stage latch pin and a bottom latch coupled to the latch-side end of the swinging gate and arranged below and in spaced-apart relation to the top latch, the bottom latch includes a bottom second-stage latch pin arranged to extend into a bottom second-pin-receiver slot when the swinging gate is in the closed position, the top pin retainer further includes an upper pin-discharge ramp adjacent to the second pin-receiver slot, the latch side frame mount also includes a bottom pin retainer that includes the bottom second pin-receiver slot and a lower pin-discharge ramp adjacent to the bottom second pin-receiver slot, and wherein the upper pin-discharge ramp is configured to discharge an outer tip of the top second-stage latch pin of the top latch from the second pin-receiver slot formed in the top pin retainer during downward movement of the top pin retainer from the raised position to the relatively lower lowered position and the lower pin-discharge ramp is configured to disengage an outer tip of the bottom second-stage latch pin of the bottom latch from the bottom second pin-receiver slot formed in the bottom pin retainer during the downward movement of the top pin retainer from the raised position to the relatively lower lowered position.

12. The process of claim 11, wherein the latch-side frame mount further includes a swing stop configured to block upward movement of the bottom pin retainer relative to the bracket.

* * * * *